US006206251B1

(12) United States Patent
Williams

(10) Patent No.: US 6,206,251 B1
(45) Date of Patent: Mar. 27, 2001

(54) POUR FLOW CONTROL DEVICE

(76) Inventor: Elden Williams, 3580 Dwayne Ct., Redding, CA (US) 96001

( * ) Notice: Subject to any disclaimer, the term of this patent is extended or adjusted under 35 U.S.C. 154(b) by 0 days.

(21) Appl. No.: 09/219,273

(22) Filed: Dec. 23, 1998

(51) Int. Cl.[7] ..... B67D 3/00

(52) U.S. Cl. ..... 222/479; 222/481.5; 222/484; 222/491; 222/494; 222/517

(58) Field of Search ..... 222/211, 212, 222/213, 479, 478, 481.5, 484, 498, 491, 507, 517, 528, 556, 541.4, 541.5, 494

(56) References Cited

U.S. PATENT DOCUMENTS

| | | | | |
|---|---|---|---|---|
| D. 325,170 | | 4/1992 | Frantz | D9/447 |
| 1,359,651 | | 11/1920 | Andrews . | |
| 2,184,215 | | 12/1939 | Geyer . | |
| 3,081,006 | | 3/1963 | Land . | |
| 3,252,632 | * | 5/1966 | Hagenes | 222/517 |
| 3,595,446 | | 7/1971 | Hellstrom | 222/213 |
| 3,934,623 | | 1/1976 | Hays | 141/98 |
| 4,105,133 | | 8/1978 | La Barge et al. | 220/266 |
| 4,207,996 | | 6/1980 | Moen | 222/507 |
| 4,219,126 | | 8/1980 | Oana | 220/89 |
| 4,541,541 | | 9/1985 | Hickman et al. | 220/253 |
| 4,598,839 | | 7/1986 | Dombroski et al. | 222/92 |
| 4,696,328 | | 9/1987 | Rhodes, Jr. | 141/1 |
| 4,789,082 | | 12/1988 | Sampson | 222/1 |
| 4,863,047 | | 9/1989 | Crow | 215/32 |
| 4,884,600 | | 12/1989 | Wilson | 141/1 |
| 4,938,390 | | 7/1990 | Markva | 222/206 |
| 4,949,857 | | 8/1990 | Russell | 215/253 |
| 4,953,706 | | 9/1990 | Piccard | 206/603 |
| 4,953,742 | | 9/1990 | Kraus | 220/367 |
| 5,101,999 | | 4/1992 | Robichaud et al. | 220/258 |
| 5,105,986 | | 4/1992 | Pham et al. | 222/145 |
| 5,273,191 | * | 12/1993 | Meshberg | 222/494 |
| 5,301,845 | | 4/1994 | Labonte | 222/211 |
| 5,377,882 | * | 1/1995 | Pham et al. | 222/484 X |
| 5,456,294 | | 10/1995 | Tsao et al. | 141/1 |
| 5,472,123 | | 12/1995 | Jangaard | 222/212 |
| 5,505,235 | | 4/1996 | Gorokhovsky et al. | 141/319 |
| 5,605,241 | | 2/1997 | Imperioli | 215/306 |
| 5,688,544 | | 11/1997 | Bolton et al. | 426/118 |
| 5,791,529 | * | 8/1998 | Mukai | 222/478 |

* cited by examiner

*Primary Examiner*—Kevin Shaver
*Assistant Examiner*—Thach Bui
(74) *Attorney, Agent, or Firm*—Coudert Brothers

(57) ABSTRACT

A valve apparatus utilizes a biased flap and air hole to regulate the flow of a fluid from the orifice of a container. The biased flap progressively opens in response to increasing fluid pressure upon the flap. An additional air hole is preferably used to permit air to continuously enter the container while fluid is discharged. A substantially smoother pouring response is achieved.

30 Claims, 14 Drawing Sheets

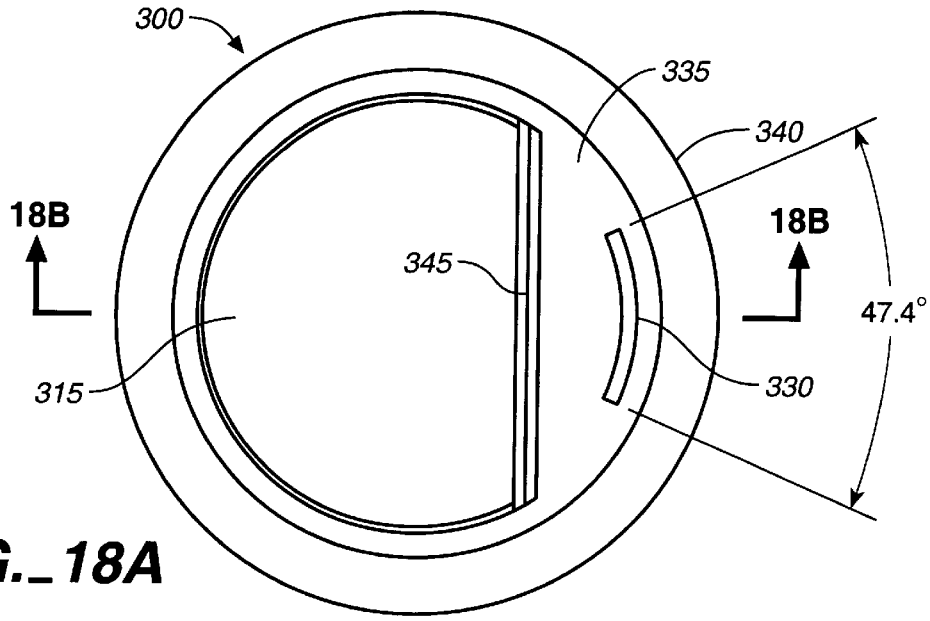
FIG._18A
FIG._18B
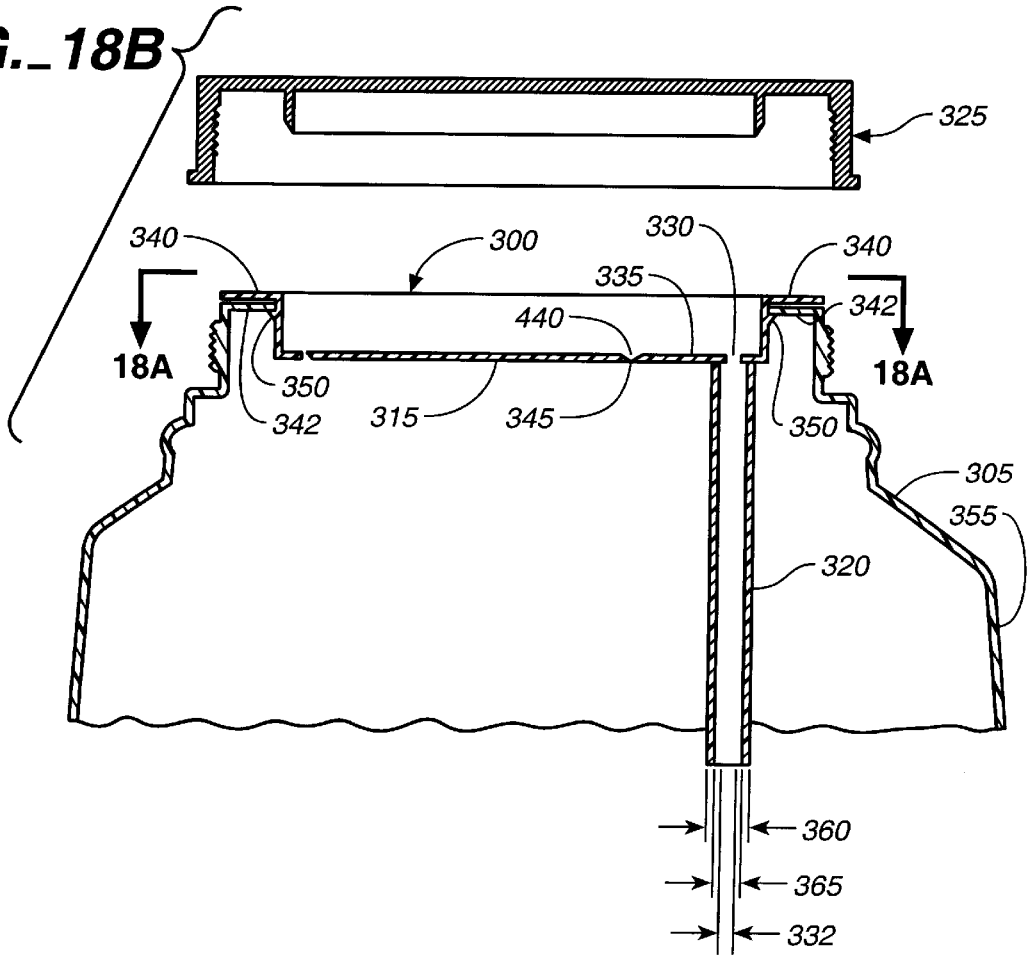

POUR FLOW CONTROL DEVICE

FIELD OF THE INVENTION

The present invention relates generally to containers and more particularly to valves and caps that control the flow of fluid being poured from the orifice of a container.

BACKGROUND OF THE INVENTION

A liquid poured from a container with a narrow neck tends to come out in spurts rather than in a continuous, steady stream. There are numerous applications where waste and spillage results because it is difficult to smoothly pour liquids from a container with a narrow neck. These applications include, but are not limited to, milk jugs, plastic water containers (e.g., one gallon distilled water or mineral water containers); wine bottles and jugs; cooking oil containers; motor oil containers, liquid bleach container, liquid laundry soap container, cleaning fluid containers, and anti-freeze containers. In many household applications, the spurting behavior leads to spilled liquids, whether it be milk, wine, or cooking oil. For example, many children spill milk because a tilted milk jug tends to spurt milk during pouring. Also, home cooks often waste cooking oil because it is difficult to smoothly pour a small amount (e.g., one teaspoon) of oil into a measuring utensil or a skillet. The spurting behavior may also lead to contamination of the environment. For example, home auto mechanics often spill motor oil onto the ground because it is difficult to smoothly pour motor oil out from the opening in the neck of a plastic oil container into an oil crankcase. Similarly, home auto mechanics often spill anti-freeze because anti-freeze spurts out from the container during pouring. Although funnels can be used to mitigate this problem, funnels may not be available, are inconvenient to use, and also dribble fluid after they are used.

The spurting behavior of a liquid being poured from a container is a consequence of well-known principles of fluid mechanics. The forces acting on a column of liquid in a container include a gravitational force and the force of the atmosphere. When a container with a narrow neck is tilted at a steep angle, liquid initially smoothly pours out of the opening in the neck of the container because of the force of gravity acting upon the fluid column. However, as liquid is discharged from the container, a vacuum tends to form in the container, particularly if the container has substantially rigid walls. Air will intermittently re-enter the container to replace the volume of the discharged fluid. Consequently, the pressure of the discharged fluid varies over time as air is intermittently admitted into the container.

The spurting behavior affects the velocity of the fluid exiting the opening or orifice of a tilted container. This changes the transverse distance the fluid stream extends as it falls, which makes it difficult to accurately pour liquid from a tilted container. For example, the fluid stream from the opening in the neck of a tilted motor oil container tends to move transversely back and forth, making it difficult to safely pour oil into the oil filler passage of a car without using a wide funnel.

One attempted solution to prior art fluid pouring problems is a seal that prevents the flow of a fluid until the container is in a desired up-ended pouring position. For example, U.S. Pat. No. 4,696,328 discloses a motor oil container that has a frangible seal. As is taught in that patent, after the neck of the oil container is inserted into the oil filler passage of a car a frangible seal is ruptured by compressing the container such that the pressure breaks the frangible seal. This prevents the type of spillage that would occur if an open neck container was poured from a distance into the oil filler passage. However, once the frangible seal is ruptured, the fluid still comes out in spurts until the container is empty. Thus, the container of U.S. Pat. No. 4,696,328 has limited applications. For example, the teachings of U.S. Pat. No. 4,696,328 are inapplicable to consumer products, such as milk containers, where it is desirable to smoothly pour a small quantity of liquid many times from the same container.

Still another attempted solution to prior art fluid pouring problems is a container having a hinged sealing cap that permits the user to maintain the cap in a closed position until the container is inverted to a pouring position. For example, U.S. Pat. No. 5,105,986 discloses a flow control device comprised of a closure member coupled by a hinge to the neck region of the flow control device having the fluid opening. The closure member is biased by the hinge to maintain the closure member in a substantially non-obstructing open position. Consequently, during normal use, the closure member does not affect the flow of liquid from the opening in the neck of the container. However, the user may manually press the closure member into a sealed position about the opening to prevent the flow of liquid from the container through the opening until the container is properly positioned. The hinged flap of U.S. Pat. No. 5,105,986 is useful to prevent spillage of oil, cleaning fluid, and other liquids. However, there are some significant drawbacks to the biased closure member of U.S. Pat. No. 5,105,986. One drawback is that the closure member may be difficult to use on large or heavy containers. For example, a one gallon anti-freeze container is heavy enough that adults typically need to grasp the container with all five fingers. That is, it may be difficult for many home mechanics to grasp the container with four fingers while using their thumb to close the closure member. Another drawback is that a closure member controlled by finger pressure may not be suitable for liquid beverages, such as milk, because of potential contamination problems. As taught in U.S. Pat. No. 5,105,986, the closure member is in close proximity to the orifice from which liquid flows. This makes it likely that a user, particularly a child with poor eye-hand coordination, would touch the lip of the orifice. Still another shortcoming of the closure flap of U.S. Pat. No. 5,105,986 is that it does not address the problem of spurting. When the closure member is in its normal, non-obstructing position it does not affect the flow of fluid from the container. Consequently, the closure flap of U.S. Pat. No. 5,105,986 does not provide a physical mechanism to substantially improve the flow behavior at low flow rates. For example, the closure flap of U.S. Pat. No. 5,105,986 would not assist a cook to smoothly pour a small quantity (e.g., one-half teaspoon) of liquid seasoning into a measuring spoon.

No previously known pour flow control device provides a simple physical mechanism to mitigate the spurting problem associated with pouring a liquid from the orifice of a container. No previously known pour flow control device adequately addresses the problem of increasing the ability of a user to smoothly control the rate of fluid flow from a container.

What is desired is pour flow control device which facilitates a steady flow of liquid from the orifice of a container.

SUMMARY OF THE INVENTION

The present invention generally comprises a valve apparatus sized to mate with a lip region of the mouth of a container formed in the neck of a container and which provides flow control for fluid exiting from the container through the mouth of the container. The present invention comprises an attachment portion dimensioned to be coupled to the lip region of the container; a flap portion coupled to the attachment portion, the flap portion sized and positioned to substantially obstruct the flow of fluid through the lip region when the flap portion is in a closed state; wherein the flap is resiliently biased so that the flap portion normally obstructs the flow of fluid through the mouth in the absence of fluid pressure but the flap portion opens a progressively greater amount in response to increasing fluid pressure against the flap portion during fluid pouring. In a preferred embodiment, an air passage is formed in the valve apparatus to permit air to continuously enter the container during fluid pouring without substantially disrupting the flow of liquid from the mouth of the container. The air passage is preferably disposed in the attachment portion of the valve apparatus and is preferably sized and positioned to function substantially as a one-way valve that lets air into the container but which prevents fluid from leaving via the air passage.

One object of the present invention is a valve apparatus having a flap portion that is biased to reduce pressure variations of the discharged liquid. Preferably, the flap portion is biased with a resilient hinge to permit the flap portion to increase the flow of liquid through the lip region of the container as the liquid pressure against the flap portion increases.

Another object of the present invention is a flap portion that acts to deflect the fluid stream exiting from the mouth of the container downwards so as to create a lower effective tilt angle, thereby reducing the transverse velocity of the fluid stream.

In still another embodiment of the present invention, the air passage communicates air into the container by an air tube to permit air to continuously enter the container a sufficient distance from the lip region of the container to reduce the turbulence of the fluid proximate to the mouth as fluid is discharged from the container.

BRIEF DESCRIPTION OF THE DRAWINGS

FIG. 18A is a top view of the valve apparatus of FIG. 17.

FIG. 18B is a side cross-sectional view along line 18B—18B of FIG. 18A, showing the valve apparatus seated in the neck of a milk container and a conventional milk container cap sized to mate around the neck of the milk container.

DETAILED DESCRIPTION OF THE INVENTION

Figure 1:
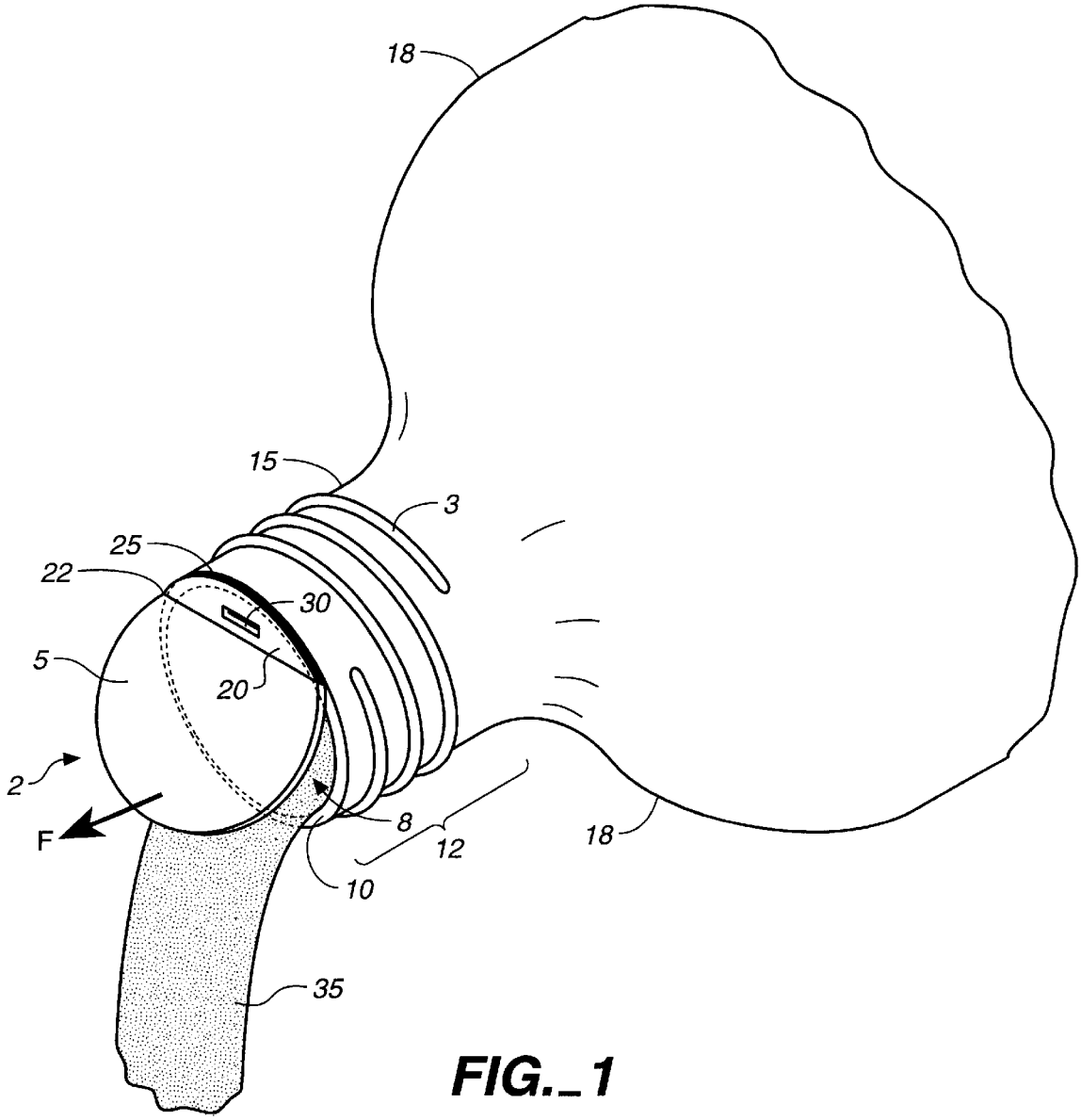
FIG. 1 is perspective view of a first embodiment of a valve apparatus coupled to the neck of a container according to the present invention.

The general principles of the present invention are illustrated with regards to the inventive valve apparatus of FIG. 1. Valve apparatus 2 includes a flap portion 5 and an attachment portion 20. Flap portion 5 is dimensioned to cover a portion of the mouth 8 which defines an orifice in the neck 15 of a container 18. The balance of mouth 8 is covered by attachment portion 20. Flap portion 5 is coupled to attachment portion 20. Attachment portion 20 is preferably affixed to the mouth of 8 of container 18 at its rim 10 along an edge region 25. In accord with a common definition, lip 12 is the structure that encircles or bounds mouth 8 in a region proximate to, and including, rim 10. The valve apparatus of FIG. 1 may thus be attached to the rim 10 or to the inner wall of neck 15 in lip region 12. As shown in FIG. 1, there may be threads 3 around the outer surface of neck 15 to support a bottle cap (not shown in FIG. 1).

Flap 5 is movably coupled to attachment portion 20 and resiliently biased so that flap 5 normally obstructs the mouth 8 of neck 15 of container 18 in the absence of fluid pressure acting on flap 5. As indicated in FIG. 1, the pressure of a fluid stream 35 against flap 5 results in a force F acting to open flap 5. That is, flap 5 is normally in a closed state that obstructs the flow of fluid through the mouth 8. However, the resilient bias is selected so that flap 5 may progressively open in response to increasing fluid pressure against flap 5, thereby decreasing the obstruction to the discharge of fluid from mouth 8 of container 18. Flap 5 is preferably hingedly connected to attachment portion 20 so that flap 5 tilts about a hinge 22. Hinge 22 may, for example, comprise a region with a reduced thickness or a region with a different materials composition to facilitate tilting of flap 5 as a substantially planar member. However, in addition to tilting about a hinge 22, flap 5 may also resiliently flex around hinge 22. Additionally, resilient flexure of attachment portion 20 may also occur. Thus, another physical mechanism that may permit flap 5 to open in response to fluid pressure on the flap is flexure of flap 5 and/or attachment portion 20. However, in a preferred embodiment, the flap progressively opens in response to increasing fluid pressure against the flap primarily as a consequence of flap 5 tilting about hinge 22.

The attachment portion 20 may be integrally formed with neck 15. Alternately, attachment portion 20 may be separately formed and coupled along an edge region 25 of neck 15 with ultrasonic bonding or other well-known bonding methods. As a third example, attachment portion 20 may also be coupled to neck 15 by snapping attachment portion 20 into a groove in lip region 12. Generally, attachment portion 20 may be attached or mounted to the rim 10 or lip region 12 of neck 15 using any of the well-known techniques in the container art for mounting tabs, caps, and covers to the neck of a container.

Figure 3:
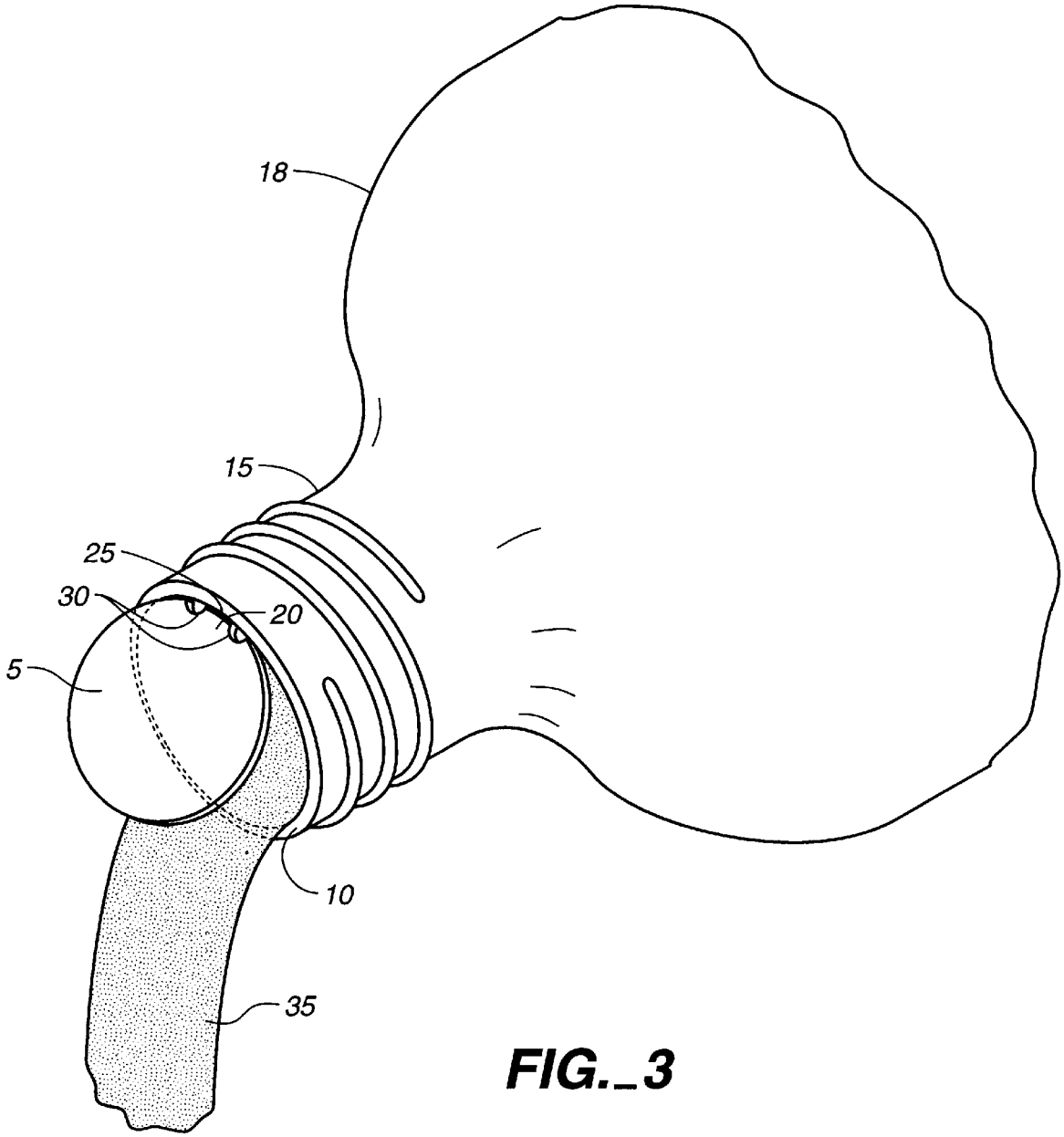
FIG. 3. is a perspective view of a third embodiment of a valve apparatus in which the air hole comprises slits formed at the periphery of the attachment portion of the valve apparatus proximate to the neck of the container.

The inventive valve apparatus preferably includes an air passage 30 formed in the valve apparatus 2 to permit air to continuously enter the container 18 as fluid is poured. The air passage 30 is sized and positioned to permit air to be communicated to the container while substantially limiting the ability for fluid in the container to flow out through the air passage. In its simplest form, air passage 30 comprises a hole with a sufficiently large cross-sectional area that air may be communicated into the container at a rate which is significant compared to the rate at which fluid is discharged from the container when fluid is poured from the container (i.e., at a rate that reduces the spurting behavior in conventional containers caused by the intermittent admittance of air into the container). Preferably, the air passage 30 communicates air into the container at a rate (cubic centimeters per second) substantially equal to the rate at which fluid is discharged (cubic centimeters per second) from the container. The air passage 30 preferably is in the form of a slit. The air passage 30 may be disposed anywhere in the valve apparatus which facilitates air continuously entering the container to replace the volume of discharged fluid. Thus, as shown in FIG. 1, the air passage 30 is preferably a hole disposed in attachment portion 20. Alternately, as shown in FIG. 3, air passage 30 may comprise slits formed along the periphery of flap 5 proximate to attachment portion 20. Placing the air passage 30 in the attachment portion allows air to enter the neck 15 of container 18 spaced apart from the region where fluid 35 is discharged from rim 10. This reduces the turbulence that would otherwise occur if air entered the same region where fluid 35 is discharged.

Figure 2:
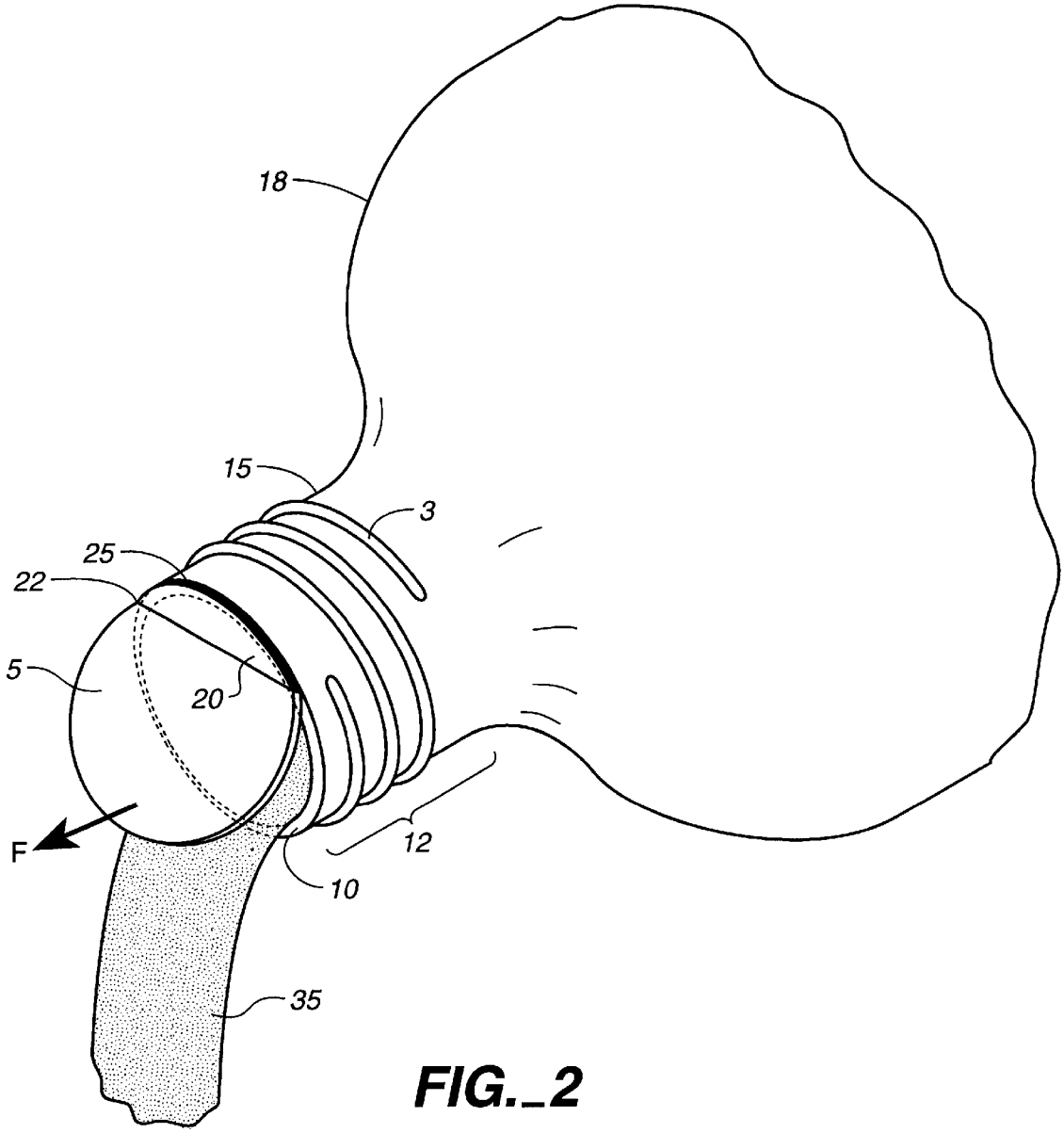
FIG. 2 is a perspective view of a second embodiment of a valve apparatus similar to FIG. 1 but with the air hole omitted.

A valve apparatus 2 with an air passage 30 is a preferred embodiment in terms of achieving the smoothest flow of fluid from a container. However, as shown in the embodiment of FIG. 2, an alternate embodiment of valve apparatus 2 has a biased flap 5 coupled to attachment portion 20 but without an air passage 30 as in the embodiment of FIG. 1. A biased flap 5 by itself provides a substantial improvement in pouring response compared to a conventional container. This is because a biased flap of the present invention acts to moderate the severity of pressure variations of the discharged fluid, even without an additional air passage. If the pressure of the fluid at the mouth suddenly increases, the force on flap 5 will cause it to swing open wider. This will increase the rate at which fluid is discharged from the container, which will tend to reduce the pressure of the fluid at mouth 8. Conversely, if the fluid pressure suddenly decreases at mouth 8, the force on flap 5 will decrease, and it will swing into a less open position. This will reduce the rate at which fluid is discharged from the container, which will help to maintain the pressure of the fluid at mouth 8. The embodiment of FIG. 2 has the potential advantage of a simpler and less expensive fabrication process compared to the embodiment of FIG. 1 while still providing a substantial improvement in pouring behavior compared to a conventional container.

The attachment portion 20 may also have a variety of shapes that perform the function of mechanically coupling flap 5 to neck 15. For example, as shown in FIG. 3, attachment portion 20 may have a comparatively small area compared to flap 5. Alternately, attachment portion 20 may comprise a cylindrical collar to facilitate coupling the valve apparatus 2 to the neck of a container.

The air passage 30 is preferably a slit. However, there are alternate methods to form a region in attachment portion 20 that perform the function of an air passage. Some thin porous materials, for example, have numerous micro-channels that permit the passage of air at low pressure but which afford a significant resistance to the flow of fluid through the micro-channels. Some woven fabric-like materials function substantially the same, i.e., providing channels for the flow of air while providing a substantial resistance to the flow of fluid. Although a variety of porous materials could be used to fabricate an air passage 30, the simplest air passage structure for common plastics is an appropriately dimensioned hole.

Figure 4:
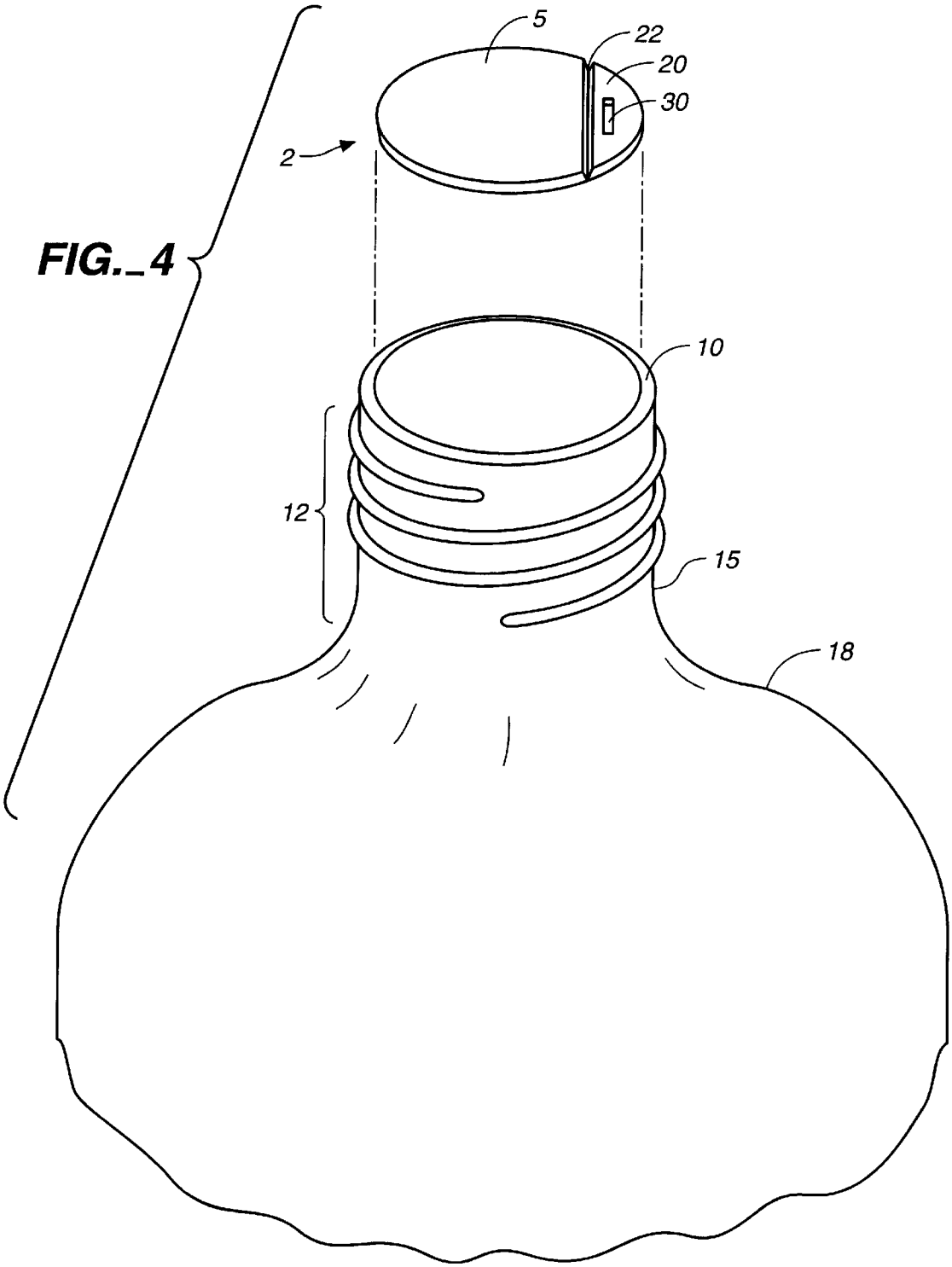
FIG. 4 is an exploded perspective view of the valve apparatus according to the present invention and a portion of a container in which the valve apparatus is fastened.

A variety of manufacturing techniques may be used to fabricate the valve apparatus 2 of the present invention. FIG. 4 is an exploded perspective view of a valve apparatus 2 and a container 18. The valve apparatus 2 preferably comprises a piece of molded plastic. A wide variety of plastics are known in the container industry. However, polypropylene is a preferred plastic for common consumer products such as milk. The polypropylene used to form the walls of common containers is comparatively stiff, but flexes under pressure. However, the thickness and materials properties of common plastics may be varied to achieve a flap element capable of hingedly swinging. For example, the materials thickness along a hinge 22 consisting of a slot 40 may be varied to form a hinge about which flap 5 may tilt. Also, many common plastics used in the container industry, such as polypropylene, are resilient so that resilient hinges 40 may be formed from regions of reduced material thickness. Additionally, the thickness of resilient materials used to fabricate flap 5 and attachment portion 20 may be selected to also permit flexure of flap 5 in response to increasing fluid pressure upon flap 5.

Figure 5:
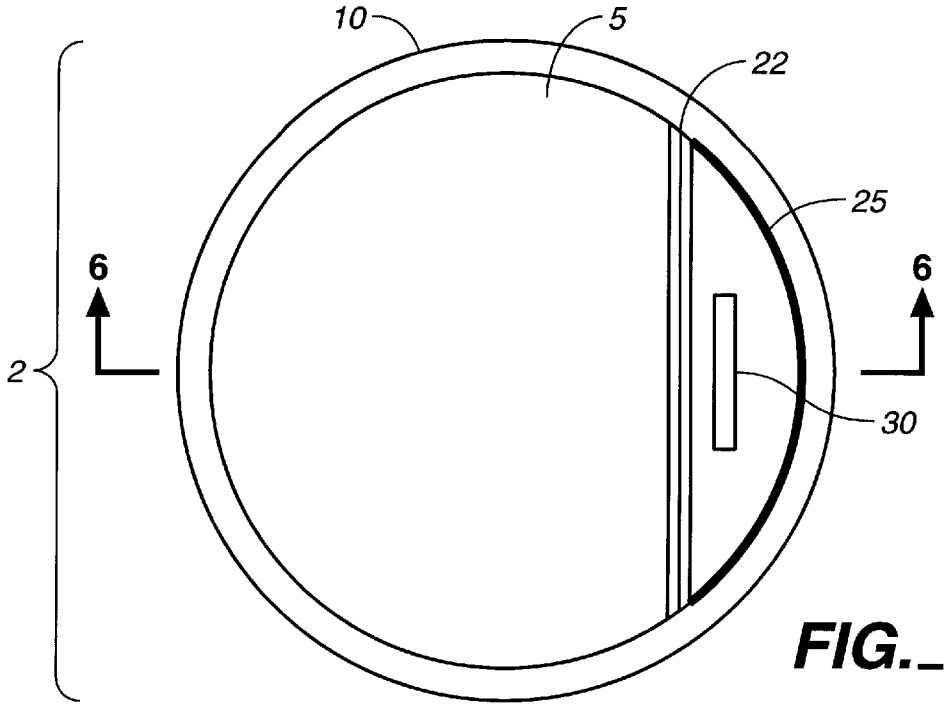
FIG. 5 is a top view of the assembled valve apparatus of FIG. 4.

FIG. 5 is a top view of the assembled valve of FIG. 4. A bonding technique, such as ultrasonic bonding, may be used to attach valve apparatus 2 to neck 15 along an arc section 25 of rim 10 or lip region 12. However, in many applications it is desirable to mechanically insert the valve apparatus 2 into the container 18 after it is filled with fluid. Consequently, it is preferable to design valve apparatus 2 to be inserted into grooves (not shown in FIG. 4) in lip region 12 of container 18. This may be done directly. However, in some cases attachment portion 20 may not be sturdy enough for a low cost insertion processes. It is well known in the fluid control art that fluid control devices may be fitted into pipes using a variety of collars designed to be attached to seating surfaces. Consequently, it may be desirable to modify attachment portion 20 to include a C-shaped or cylindrical collar extending around flap 5 in order to increase the mechanical strength of attachment portion 20 so that it may be seated into a groove or other seating surface disposed in lip region 12.

Figure 6:
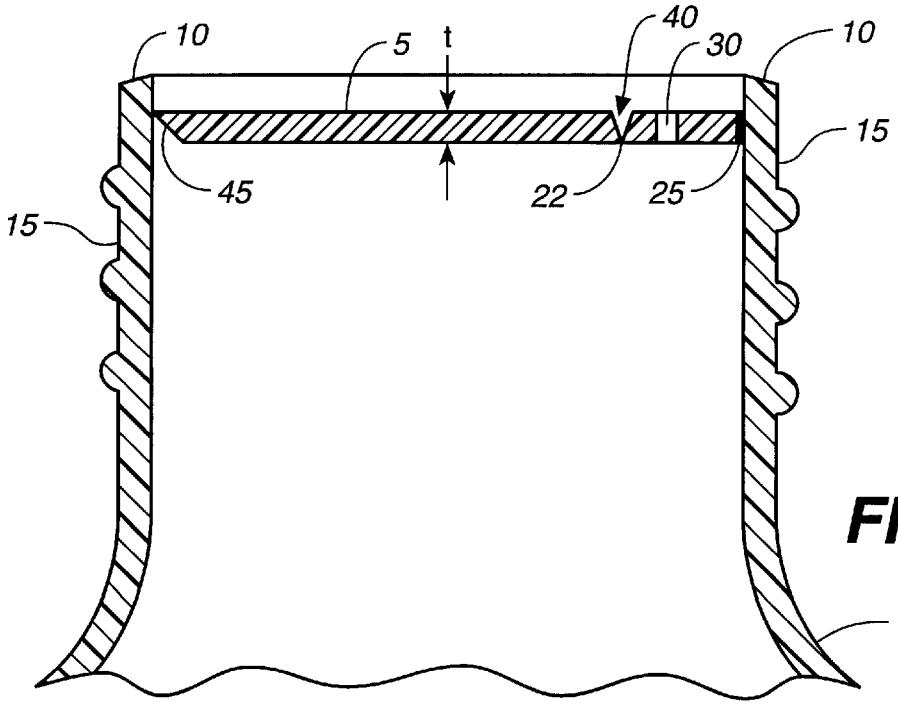
FIG. 6 is a cross-sectional view of the valve apparatus of FIG. 5 along line 6—6 of FIG. 5.

The flap 5 is preferably shaped to facilitate the smooth flow of liquid over the flap. FIG. 6 is a cross-sectional view of the flap of FIG. 5 along the line 6—6. As seen in FIG. 6, flap 5 may have a tapered edge 45 to facilitate the smooth flow of liquid across the flap. However, in many cases, such as that of thick viscous liquids flowing at low pressure, a tapered edge may not be necessary to achieve a smooth flow over the edge of flap 5. As also shown in FIG. 6, hinge 22 preferably comprises a slot 40 with a region of reduced material thickness compared to the thickness of flap 5.

Figure 7:
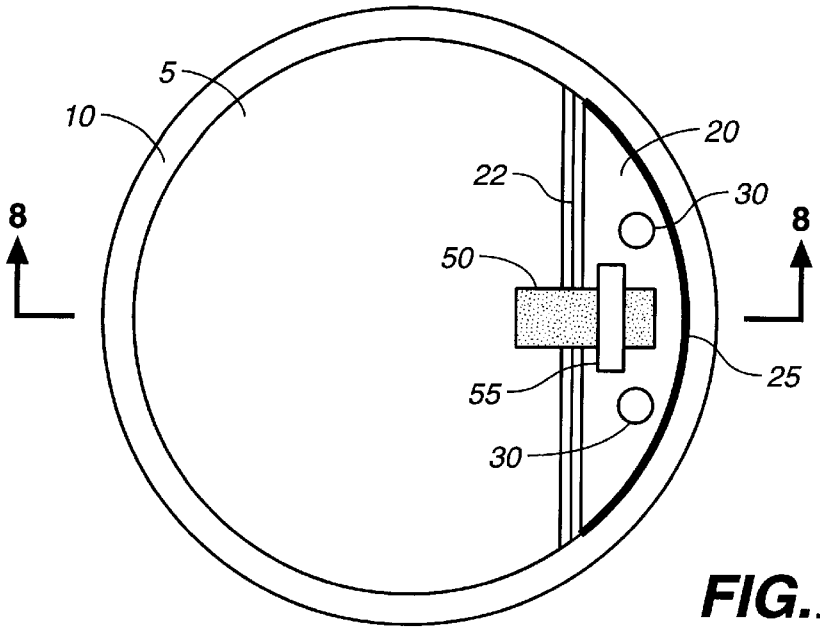
FIG. 7 is a top view of a valve apparatus including an additional leaf spring to bias the flap.

The valve apparatus 2 of the present invention may also incorporate a leaf spring structure to control the bias on the flap. FIG. 7 is a top view of pour control device comprising a flap 5 coupled to attachment portion 20 mounted to neck 15 along edge region 25. Air holes 30 are formed in attachment portion 20 on opposite sides of leaf spring 50. However, an additional leaf spring 50 extends over both attachment portion 20 and a portion of flap 5. Leaf spring 50 may be constructed using one of a variety of resilient plastics or other materials.

In one embodiment, the leaf spring 50 is permanently fixed above hinge 22 and is affixed to attachment portion 20. A permanent leaf spring 50 may comprise a strip of resilient material bonded or otherwise coupled to attachment portion 20 so as to provide a significant or substantial portion of the bias acting to close flap 5. However, as indicated in FIG. 7, in a preferred embodiment the leaf spring couples the attachment portion 20 to flap 5 via a holder 55. Preferably the position of leaf spring 50 in holder 55 is adjustable by the user in order that the restorative force may be selected to customize the response of the valve apparatus for a particular application, e.g., as required for different liquids.

Figure 8:
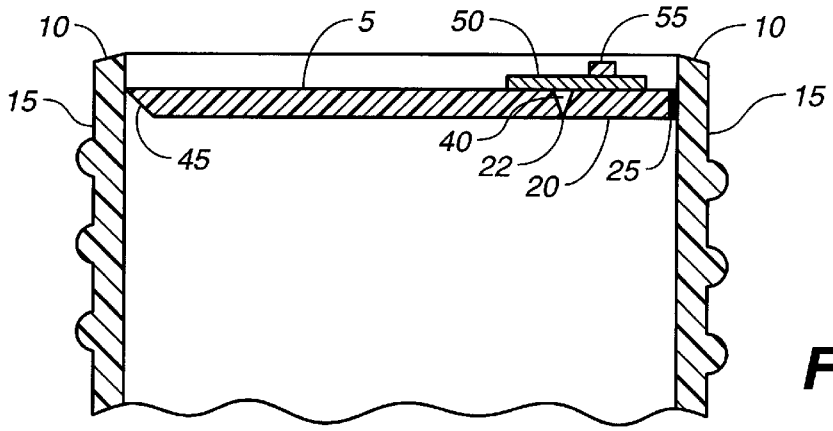
FIG. 8 is a cross-sectional view of the valve apparatus of FIG. 7 along line 8—8.
Figure 9:
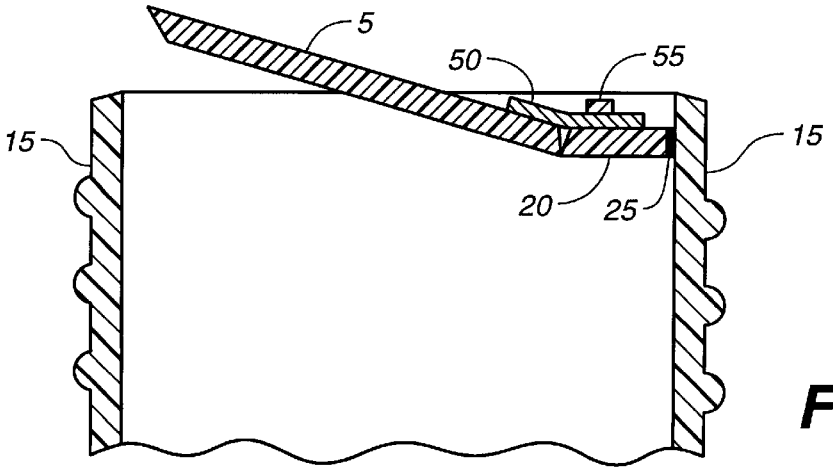
FIG. 9. is a cross-sectional view similar to FIG. 8 but showing the flap in an open pouring position.

FIG. 8 is a cross sectional view of the valve apparatus of FIG. 7 along the line 8—8 with the flap 5 shown in a closed position. FIG. 9 is a cross-sectional view of the valve apparatus of FIG. 7 along the line 8—8 with the flap 5 shown in an open position as when a fluid force is being applied to flap 5. Leaf spring 50 bends when the flap 5 swings open to provide a restorative force acting to close flap 5.

Figure 10:
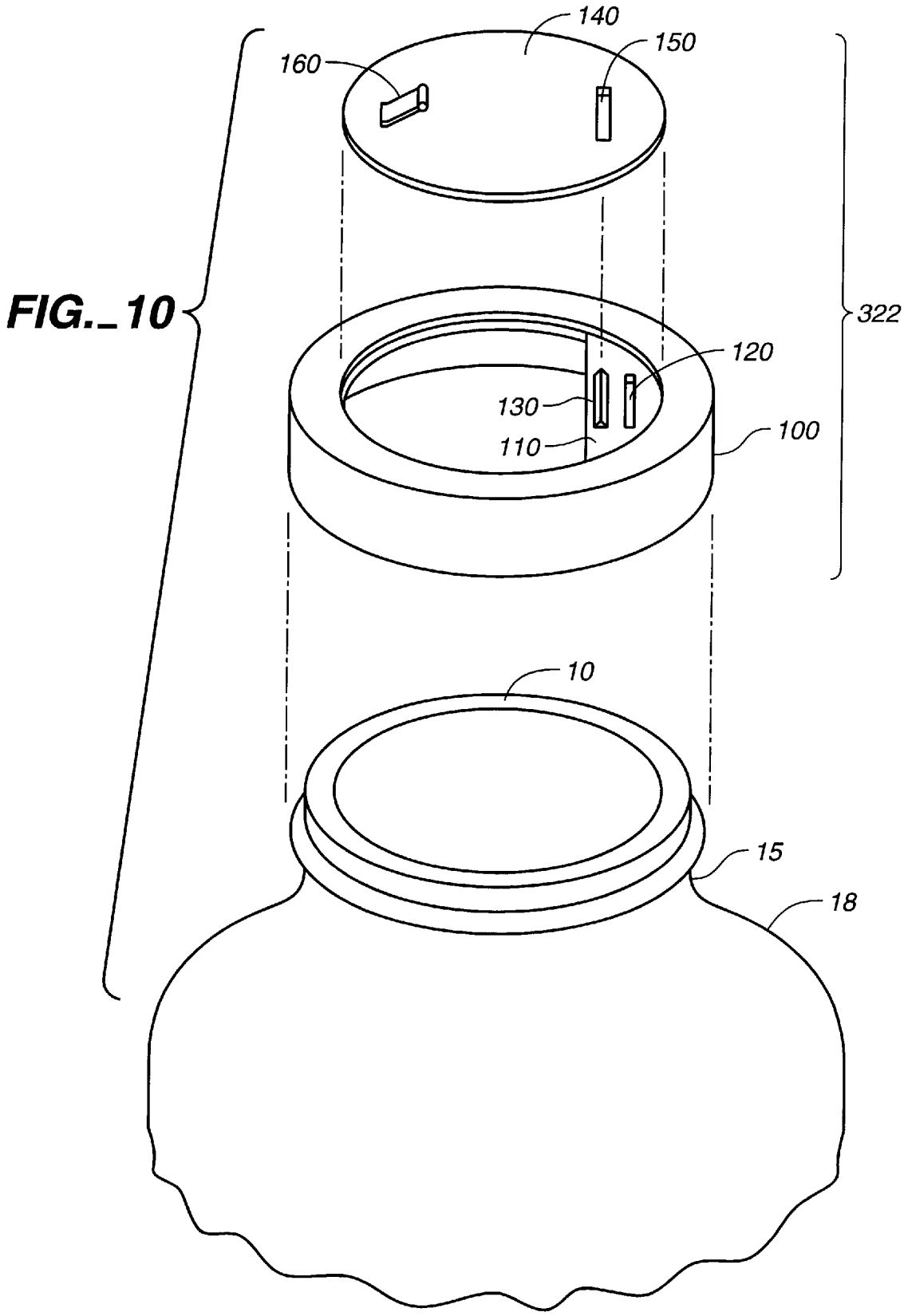
FIG. 10 is an exploded perspective view of a valve apparatus designed to mate around the exterior neck surface of a container.

In another embodiment, the valve apparatus is designed to be mounted on the exterior surface of the neck 15 of a container 18. FIG. 10 is an exploded perspective view of an externally mountable valve apparatus 322 designed to be mounted on a container 18. In the embodiment of FIG. 10, the flap 140 also functions as a sealing element. As shown in FIG. 10, attachment portion 100 is a collar shaped unit that includes a support frame 110. Support frame 110 also has a plug element 130 disposed upon its surface. As shown in FIG. 10, flap 140 includes a primary air hole 150. Preferably there is a tab 160 disposed on flap 140 to permit the flap 140 to be pulled. A second air hole 120 is disposed on a portion of support frame 110. As indicated in the top view of FIG. 11, the flap 140 is coupled to attachment portion 100 along an edge region 170. The resiliency of the material along edge 170 provides a resilient hinge connection. Flap 140 may be attached to support frame 110 using ultrasonic bonding or other bonding techniques.

Figure 11:
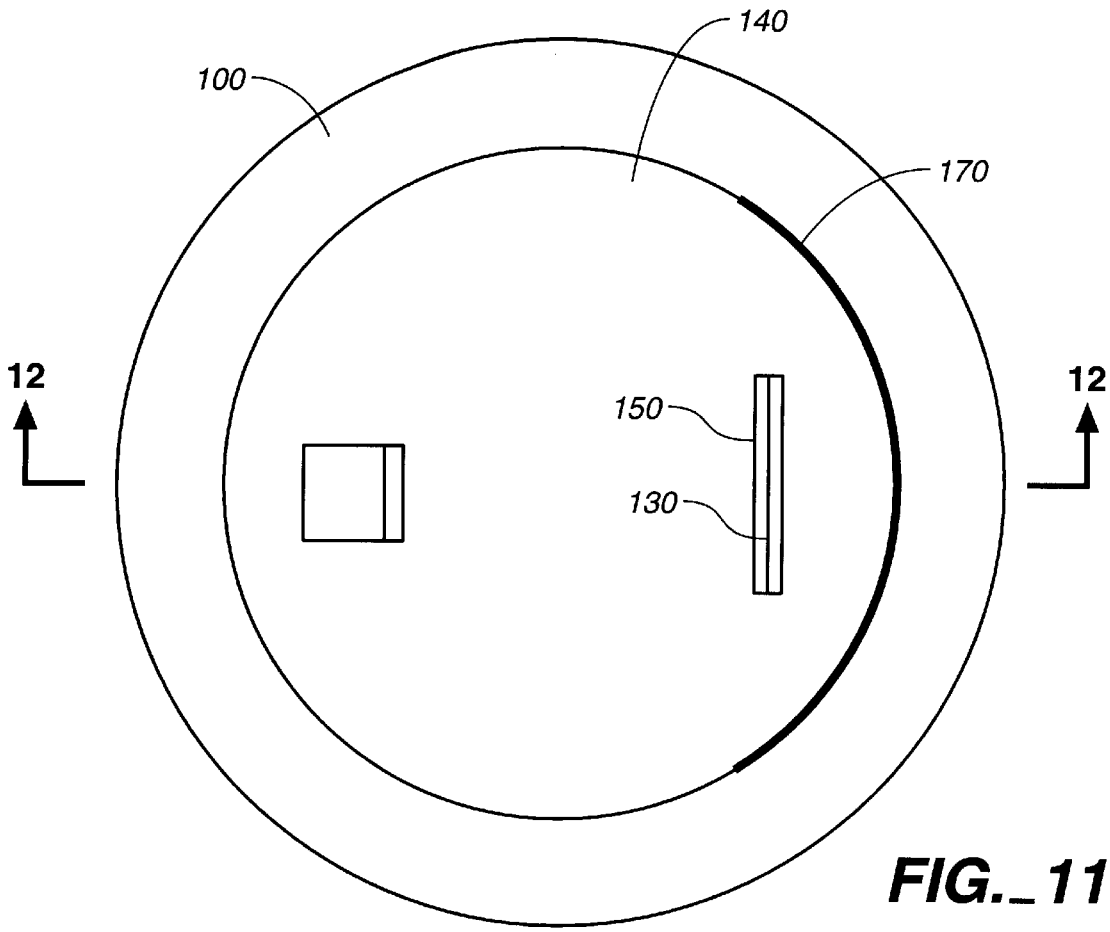
FIG. 11. is top view of the valve apparatus of FIG. 10.
Figure 12:
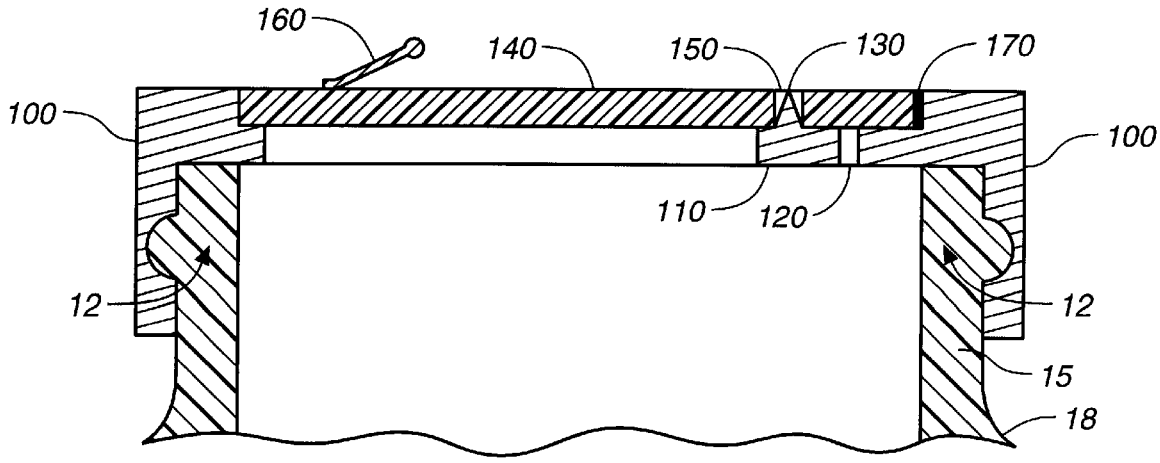
FIG. 12 is a cross-sectional side view of the assembled valve apparatus of FIG. 10 along the line 12—12 of FIG. 11 coupled to the neck of a container with the flap in a sealed position.
Figure 13:
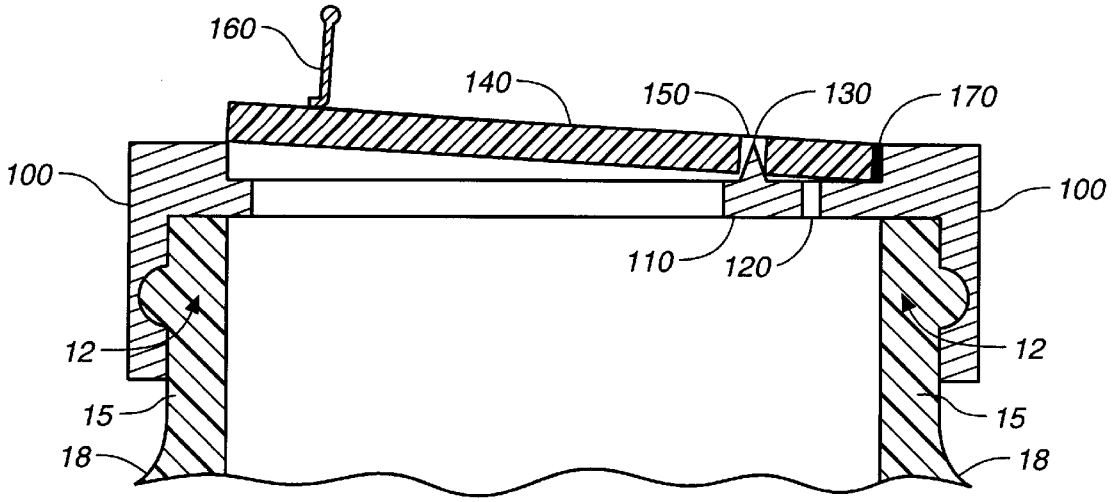
FIG. 13 is a cross-sectional side view of the assembled valve apparatus of FIG. 10 along the line 12—12 of FIG. 11 coupled to the neck of a container with the flap pulled out from its sealed position.
Figure 14:
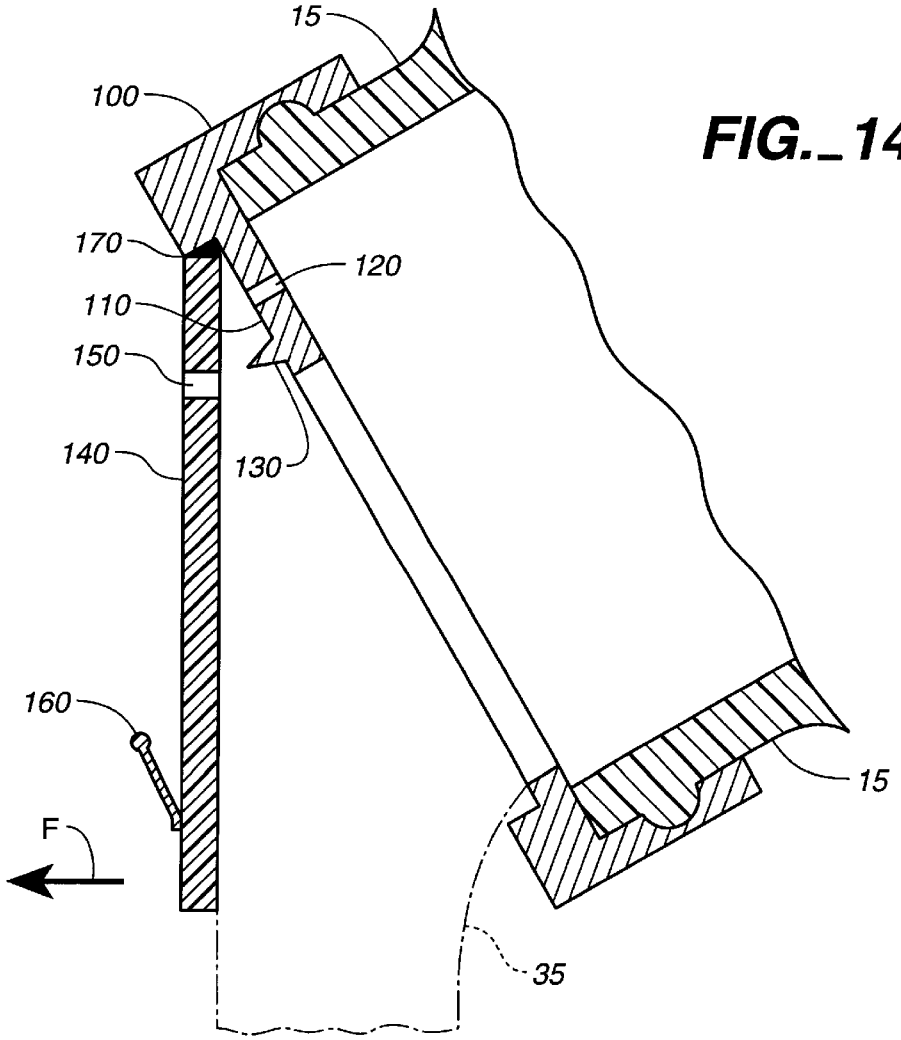
FIG. 14 is a cross-sectional side view of the assembled valve apparatus of FIG. 10 along the line 12—12 of FIG. 11 with the flap opened by the pressure of the fluid, shown in phantom, flowing from the container.

FIG. 12 is cross-sectional diagram of the assembled valve apparatus 322 of FIG. 10 along line 12—12 of FIG. 11 mounted to the exterior surface of lip region 12 of the neck 15 of a separate container 18. The attachment portion 100 is shaped to mate around the lip region 12 of the container 18. For example, attachment portion 100 may be shaped to mate around the neck of a wine bottle. As shown in FIG. 12, in a sealed flap position the primary air hole 150 is sealed by plug 130 disposed on support frame 110. The sealed flap position is one in which the flap 140 seals the contents of container 18 from contamination. This allows the valve apparatus 322 to be used without an additional cap. This permits flap element 140 to be used to seal a container when the container is not in use, thus eliminating the need for a separate cover. The exterior air hole 150 is sealed by plug element 130. As shown in the cross-section of FIG. 13, the user may pull upon tab 160 to decouple air hole 150 from plug 130. As indicated in FIG. 13, flap 140 is biased to obstruct the orifice of the container in the absence of fluid pressure by restorative forces generated by edge region 170 and/or the flexure of flap 140. As shown in the cross section of FIG. 14, the container may then be tilted so that the flap 140 is opened by the pressure of a fluid stream 35 (shown in phantom) discharged from the container. The air passage in FIG. 14 comprises air passing through the primary air hole 150 and thence into the container through secondary air hole 120.

Figure 15:
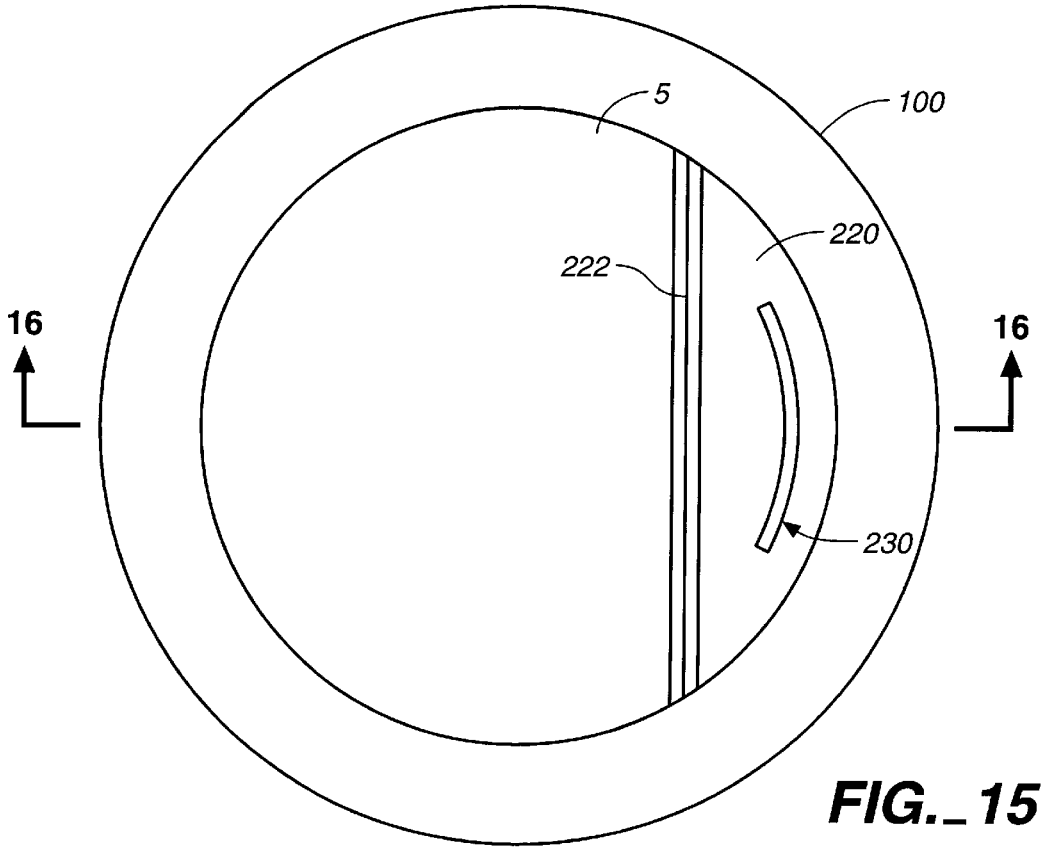
FIG. 15 is a top view of an embodiment of a valve apparatus with an air slit and air tube.
Figure 16:
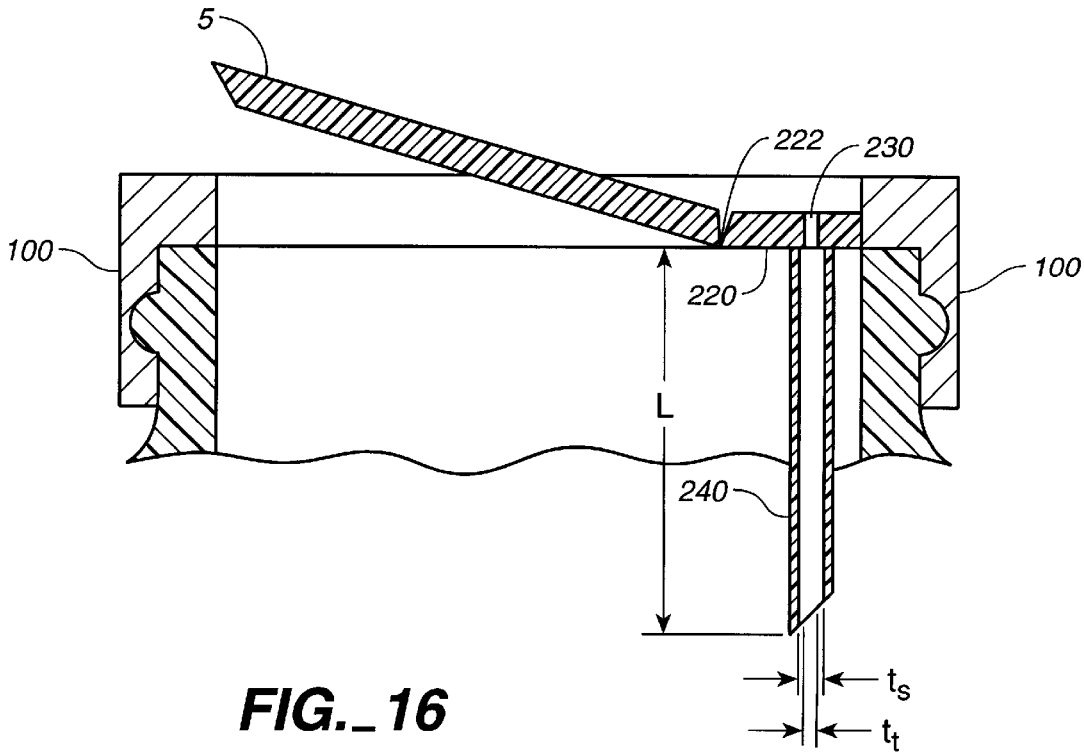
FIG. 16 is a cross-sectional side view of the valve apparatus of FIG. 15 along the line 16—16 with the flap in an open pouring position.

FIG. 15 is a top view of another embodiment of an externally mountable valve apparatus with an air passage comprising an air slit 230 and air tube 240 (shown in FIG. 16). A flap 5 is hingedly connected to a support section 220 of attachment portion 100 by hinge 222. An air slit 230 is disposed in support section 220. FIG. 16 is a cross-sectional view of the mounted valve apparatus of FIG. 15 along line 16—16 with the flap 5 shown in an open (pouring) position. The attachment portion 100 mates around the neck of a container (shown in phantom). As shown in FIG. 16, air slit 230 communicates air to the container through air tube 240.

The air slit 230 is preferably selected so that the air slit 230 acts substantially as a one-way air valve that lets air into the container while substantially preventing fluid from exiting the container from the air slit 230. The resistance to the flow of a fluid through an orifice may be calculated by those of ordinary skill in the art of mechanical engineering according to well-known principles of fluid mechanics. Generally, the resistance to the flow of fluid through an orifice will depend upon several parameters, including the viscosity of the liquid and the frictional forces associated with the walls of the orifice. As shown in FIG. 16, air slit 230 has a width $t_r$. Air slit 230 is preferably selected to be a comparatively narrow slit. This increases the resistance for liquid to flow out of air slit 230. However, air may flow into a comparatively narrow air slit 230 with relatively little resistance. Narrow slits function substantially as one-way air valves, letting air in but substantially preventing the out flow of fluid, at least at the common fluid pressures encountered in one-gallon containers. Air slit widths between 0.020" (0.508 millimeters) and 0.040" (0.762 millimeters) appear to work the best for common water-based liquids, with an air slit width of about 0.030" (1.5240 millimeters) being a preferred air slit width for water-based liquids such as milk. Narrower slits may also be used. However, narrower slits are more difficult to manufacture. The air slit 230 preferably is long enough that the slit 230 has a significant area to attain a low resistance to flow of air into the container. This facilitates air entering the container at about the same rate that fluid is discharged. The preferred air slit 230 width will depend upon the fluid that is being poured. For example, oils, such as motor oils, are often viscous enough that a slit width of about 0.060" is sufficient to achieve a substantially one-way air valve in which air is let into the air slit 230 but oil does not pour out from the air slit 230.

The inventor has also developed a preferred method to reduce the turbulence that would otherwise occur as a consequence of air continuously entering the neck of the container proximate to the region where fluid is discharged. As shown in FIG. 16, air may be communicated into the container a substantial distance from where fluid is discharged by communicating air from slit 230 into the container by an air tube 240. The inventor believes that an air tube 240 reduces the turbulence of the liquid proximate to the exit. For common long-necked bottles, an air tube whose length, L, is about one-half inch in length (1.27 centimeters) produces a significant improvement in the smoothness of the fluid stream. However, many containers, such as one-gallon liquid bleach containers, have a hollow handle portion proximate to their neck. For containers having a hollow handle proximate to the neck region, the air tube 240 is preferably long enough that the end of the tube is disposed proximate to the upper end of the hollow handle. As shown in FIG. 16, air tube 240 preferably has an inner width (diameter), $t_s$, slightly wider than width (diameter) $t_t$ of air slit 230 in order to maintain a comparatively low resistance for the flow of air into the container. Experiments by the inventor indicate that for common water-based fluids, an air slit width of about 0.030" (0.762 millimeters) in width with an air tube 240 with a width, $t_t$ of about 0.060" (1.524 millimeters) produces the best results in terms of fluid turbulence. These choices of dimensions have the effect that air tube 240 remains substantially dry during operation, indicating that the air slit 230 lets air in but little or no liquid is allowed to pass in the opposite direction through air tube 240 into air slit 230.

An additional important consideration in the design of a valve apparatus for use with liquid beverages is the issue of health safety. There are numerous packaging laws for milk, juice, and other beverages. Many of these laws are related to the fact that bacteria growth in perishable food products may endanger human health. For example, many juice manufacturers take extraordinary measures to reduce even the slightest possibility of bacteria contamination of their products. Similarly, many milk manufacturers take strong, proactive measures to reduce the potential for bacterial contamination. One consideration in designing a valve apparatus for a milk or juice container is preventing cross-contamination from the machine used to insert the valve apparatus. Another consideration is to minimize surfaces in which bacteria are inclined to grow.

Figure 17:
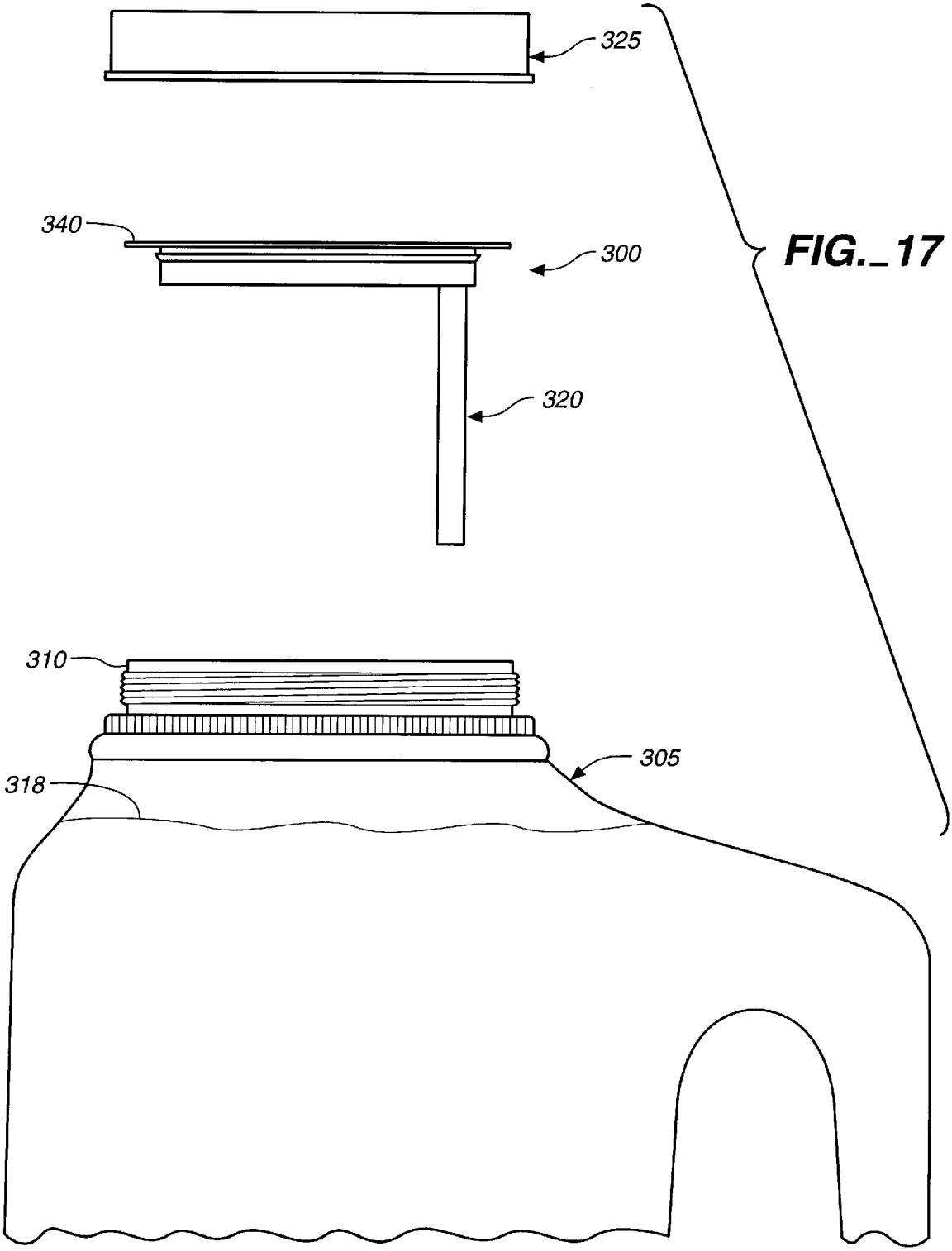
FIG. 17 is a side view of an externally mounted valve apparatus for milk containers showing the milk container, the valve apparatus, and a conventional milk cap.

FIG. 17 is an side view of a valve apparatus 300 dimensioned to be inserted into a standard one-gallon plastic milk container 305 and sealed with a plastic milk bottle cap 325. The valve apparatus 300 is shaped to be inserted, i.e., plugged into, the mouth portion of the neck 310 of a plastic milk bottle 305. As indicated in FIG. 17, the valve apparatus 300 has a supporting rim 340. As shown in FIG. 17, it is preferable that a valve apparatus 300 for a milk container utilizes an air slit (not shown) and air tube 320 to allow air to enter the container with minimal turbulence.

One advantage of the embodiment of FIG. 17 is that the exterior surface of valve apparatus 300 may be manipulated during the mating process without bringing a mechanical device into close proximity to the milk 318 in the filled milk container 305. Another advantage of the valve apparatus 300 is that the pour flow control flap (not shown in side view) may be manufactured as an integral unit that minimize surfaces (e.g., narrow grooves or recesses) that may deleteriously promote contamination or spoilage. Thus, the embodiment of FIG. 17 is a preferred embodiment for milk containers, although it may also be used in a variety of other types of containers as well.

FIG. 18A is a top view of the valve apparatus 300. The milk container, which is substantially larger in diameter than the cap, is omitted in FIG. 18A. The valve apparatus has a rim section 340. A flap portion 315 is hingedly connected by hinge 345 to an attachment portion 335. Attachment portion 335 is coupled to rim 340. Additionally, an air slit 330 is formed in attachment portion 340. In a preferred embodiment, the air slit 330 about 0.030" in width and is arc-shaped, and as shown in FIG. 18A occupies an arc angle in excess of about 45 degrees. FIG. 18B is a cross-sectional view of the valve apparatus of FIG. 18A along the line 18B—18B. The container 305 and container cap 325 are also shown in cross section to demonstrate how the valve apparatus 300 is seated in the neck 310 of container 305. As shown in FIG. 18B, a conventional one-gallon milk container typically has a surface 342 upon which rim 340 of valve apparatus 300 may be supported. Additionally, valve apparatus 300 preferably has ledges 350 shaped to wedge surfaces 342 between rim 340 and ledges 350 when valve apparatus 300 in plugged into the neck of container 305.

As shown in FIG. 18B, the valve apparatus 300 has an air slit 330 that is coupled to air tube 320 and communicates air to container 305 via air tube 320. The air slit 330 preferably has slit width 332 of about 0.030". The air tube 320 preferably has an inner width of 0.060". The valve apparatus is preferably constructed from the same polypropylene material used to fabricate the milk container 305. Although the thickness of the polypropylene used in milk containers may vary somewhat, it is typically in the range of about 0.020" to 0.030". The flap 315 preferably has a thickness of between about 0.010" to 0.015" (0.254 to 0.381 millimeters) and the hinge 345 preferably has slot 440 so that its thickness is about 0.0075" (0.1905 millimeters). As indicated in FIG. 18B, the valve apparatus 300 preferably seats onto container 305 so that a standard container cap 325 may be used to seal the milk container 305.

While FIG. 18B shows a preferred friction fitting for milk containers, more generally the valve apparatus of FIGS. 17, 18A, and 18B of the present invention may be shaped to mate with a variety of containers. Thus, the valve apparatus 300 of FIG. 17 may also be shaped to mate into the necks of other containers, such as thermos bottles. Thus, the present invention more generally includes embodiments in which the valve apparatus is coupled to the neck of the container by inserting the valve apparatus into the neck similarly.

A plurality of physical mechanisms are believed to lead to an improved pour flow response obtained according to the present invention. Although there may be other contributing physical mechanisms, it is believed that there are four principal physical mechanisms that improve the pour flow response of the present invention. First, the biased flap of the present invention acts to moderate pressure surges. In the present invention, flap 5 is biased to obstruct the mouth of the container in the absence of fluid pressure but to progressively open wider with increasing fluid pressure. The effective orifice size of the container increases with increasing fluid pressure. Since an increase in the effective orifice size of a container leads to higher fluid flow rates, which reduces output pressure, the biased flap of the present invention tends to moderate pressure surges of the discharged fluid.

Figure 19:
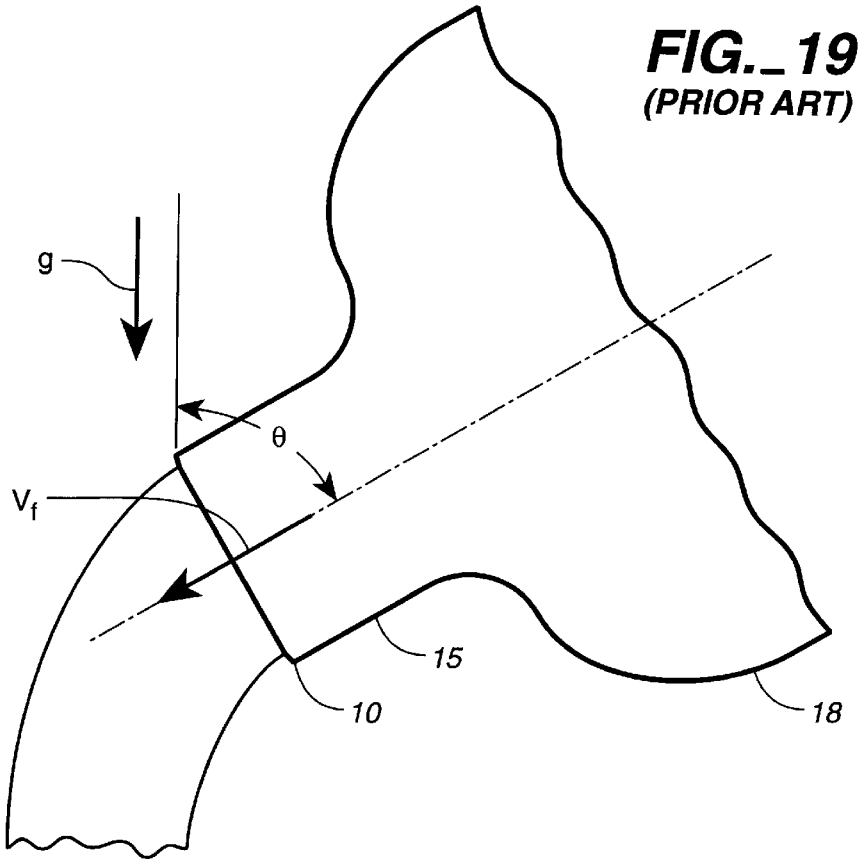
FIG. 19 (PRIOR ART)
FIG. 19 is side view showing the liquid stream of a conventional container exiting the container at about the same tilt angle as the container.
Figure 20:
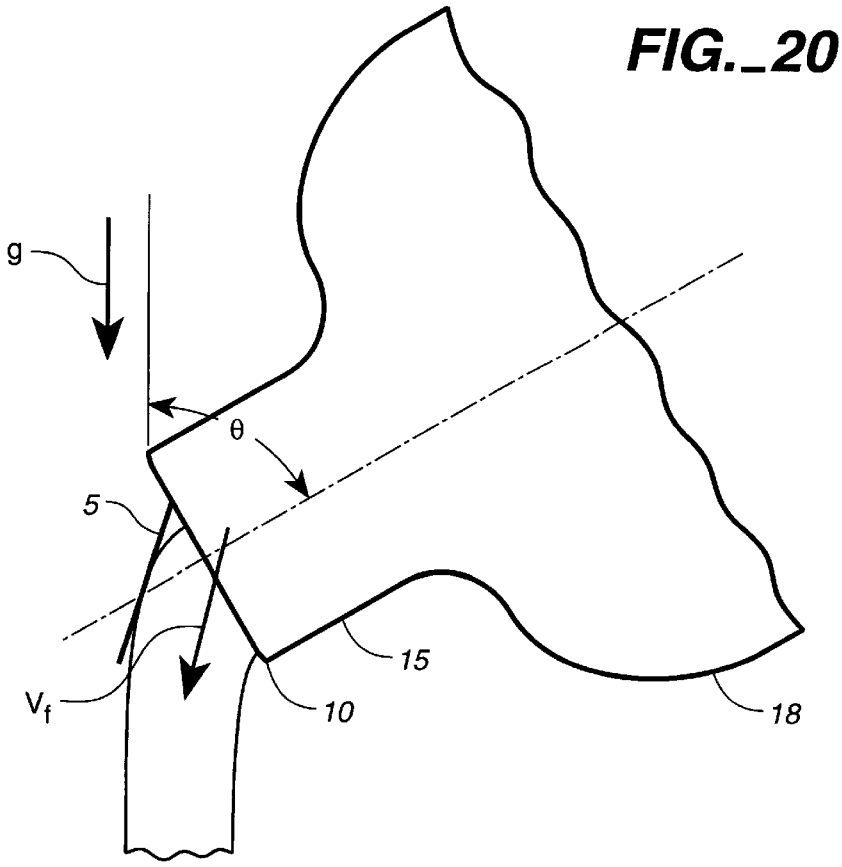
FIG. 20 is a side view showing how the liquid stream from the inventive valve apparatus has a reduced tilt angle compared to the container.

Second, the biased flap of the present invention reduces the effect of pressure surges upon the transverse deflection distance of the fluid stream. As is well known, a fluid exiting the orifice of an tilted container will traverse an arc-shaped path. The shape of the arc can be determined by calculating the effect of gravity and the magnitude and direction of the velocity of the fluid stream as it exits the mouth of the container. The magnitude of the velocity of the fluid stream depends upon the pressure at the orifice. Referring to FIG. 19, fluid exits the rim 10 of the neck 15 of a conventional container 18 at the same angle as the container itself. The tilt angle is measured with respect to the downward force of gravity, g. The velocity vector, $V_f$, of the fluid stream is in the same direction as the container. The velocity vector has a component directed downwards and a component directed transversely from the neck 15 of container 18. The relative ratio of the vertical to transverse component of the velocity of the fluid stream is given by the tangent of the tilt angle. Consequently, the relative transverse component of velocity is low for a small tilt angle, θ, and increases steadily with tilt angle up to ninety degrees. Referring to FIG. 20, in the present invention the flap deflects the fluid stream to a lower effective tilt angle, i.e., more straight down in the direction of the force of gravity, g, thereby reducing the transverse velocity of the fluid stream. Consequently, even if pressure surges occur they will cause a smaller change in the transverse component of the velocity of the fluid stream compared to the case in FIG. 19 where the fluid is discharged in the same direction as the central axis of the container.

Third, the valve apparatus of the present invention preferably has an air passage that permits air to be substantially continuously admitted to the container to replace the volume of discharged fluid. In conventional containers, the pressure of the output fluid intermittently drops as the container draws in air. There is also substantial turbulence caused by this intermittent process. However, in the present invention the air passage communicates air into the container. This reduces pressure variations in the discharged liquid and the turbulence of the fluid as it is discharged. The air passages are preferably slits with a narrow width. An air slit with a narrow width permits air to enter the container 18 with a comparatively low resistance. However, if the slit is sufficiently narrow the resistance for the flow of a fluid through the slit is quite large. Moreover, the fluid pressure is comparatively low so that an air slit 30 may function substantially as a one-way air valve which lets air into the container 18 while largely preventing the flow of fluid out from air slit 30.

Figure 21:
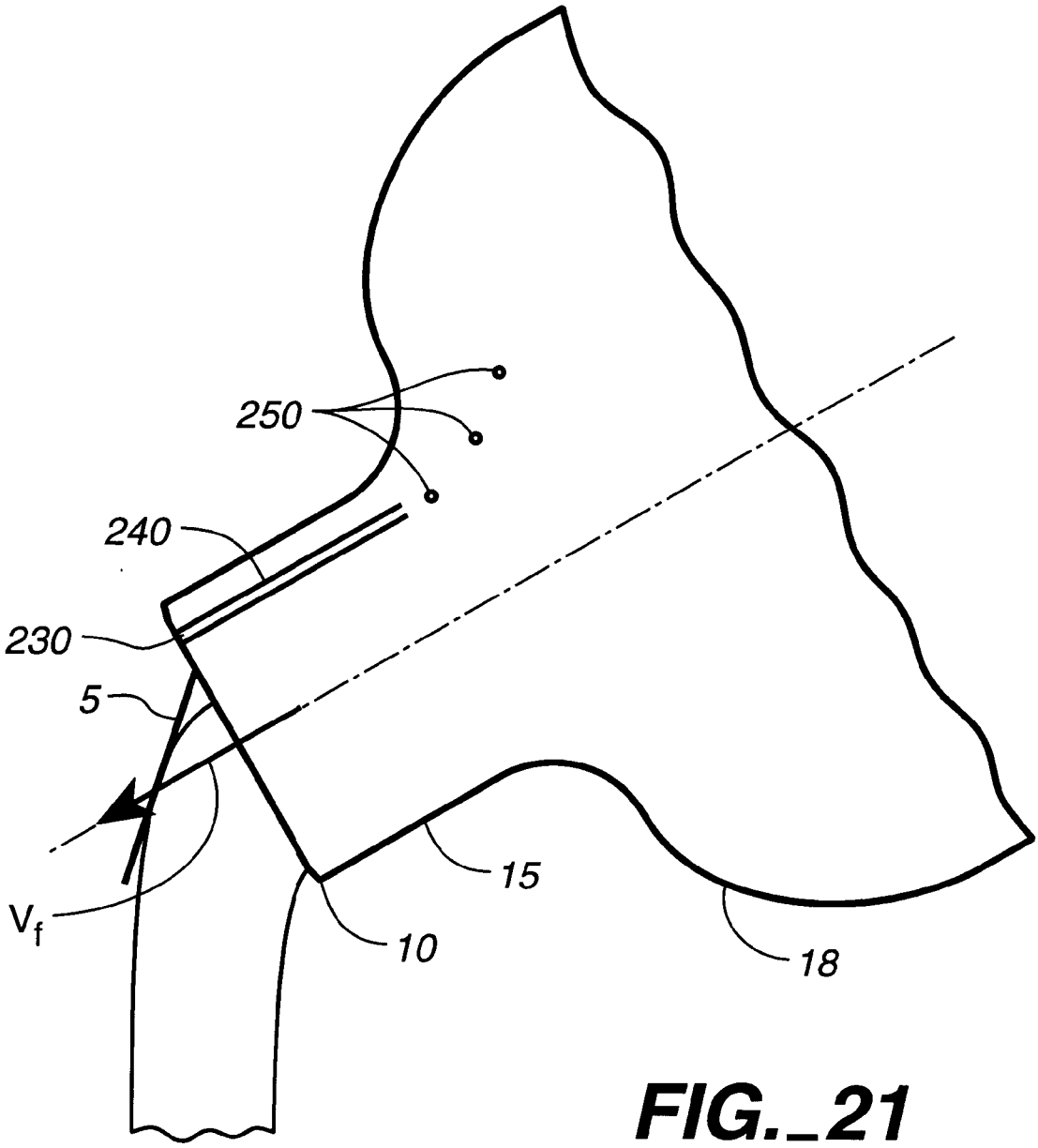
FIG. 21 is a side view showing how a valve apparatus with an extended air tube lets air into the container a significant distance from the orifice of the container.

Fourth, in a preferred embodiment the air passage comprises an air tube 240 connected to the air hole 230, which communicates air into the container a substantial distance from the rim where fluid is discharged. This reduces the turbulence of liquid proximate to the orifice. As shown in FIG. 21, the air tube 240 permits air bubbles 250 to enter the container a substantial distance from the rim 10 of neck 15 where fluid leaves the container 18. This permits a significantly smoother flow of fluid from the container compared with a configuration in which air and liquid must mix proximate to the orifice. Turbulence is greatly reduced, which produces a significantly smoother flow of discharged fluid.

The relative importance of the above described four principles can be adjusted for a particular application to achieve the desired pour flow control. Moreover, cost considerations may affect the design choice for a particular application. For example, in some applications the least expensive valve apparatus using the simplest manufacturing process may be acceptable. For example, for the case of a bottled-water container, an inexpensive valve apparatus relying solely on a biased flap to regulate the flow may be sufficient to significantly improve the flow compared to a conventional container. However, in other applications the smoothest possible pour flow control response may be desired to avoid spillage. For example, in a valve apparatus for a wine bottle, the combination of a biased flap, air holes, and air tubes may provide the smooth and controllable pouring response desired to aid those with poor eye-hand coordination to safely pour red wine without dripping wine onto a tablecloth.

Flap size and flap bias may be selected based upon the desired application. For example, a flap used in a valve apparatus for a milk container should permit a reasonable flow rate over a reasonable range of tilt angles. The bias on the flap can be adjusted, such as by varying the material's thickness on a resilient hinge, until the pour flow response is suited to a particular application. For the case of standard polypropylene materials, most containers typically have a polypropylene thickness in the range of about 0.020" to 0.050" (0.508 to 1.27 millimeters), depending upon the particular application. The thickness of the hinge region may thus be varied over a wide range. For example, varying the thickness of the hinge region between about 0.0075" to 0.015" (0.1905 to 0.381 millimeters) to substantially varies the bias on a flap. Moreover, the length of the hinge is a further variable. A longer hinge will tend to provide a stronger bias compared to one with a shorter length. As indicated in the embodiment of FIG. 3, the present invention teaches that the effective hinge length is also a variable. If necessary, the hinge length may also be varied to adjust the bias on the flap. Moreover, as indicated in FIG. 7, an additional element performing the function of a leaf spring may be added to provide increased bias on the flap. Additionally, while it is preferable that the flap swings, the thickness of the flap may also be selected to permit resilient flexure of the flap. Generally, a package designer would adjust the above-described variables until the flap bias was set so that the flap was substantially closed at high container tilt angles (corresponding to an angle, θ, of about ninety degrees in FIG. 20 and to a low fluid pressure on the flap) and substantially open at a low tilt angle (corresponding to an angle, θ, of substantially less than ninety degrees in FIG. 20 and to a high fluid pressure on the flap). It is also desirable that the flap bias is selected so that the flap progressively opens in response to increasing fluid pressure on the flap. This facilitates the user controlling the flow rate of discharged fluid by adjusting the tilt angle of the container.

The air hole design is preferably selected consistent with the intended flow rates for a particular application. For example, a valve apparatus intended for an application in which comparatively fast pouring is desired (e.g., a milk container) preferably has somewhat longer air slits than an application in which only a relatively slow flow rate is desired (e.g., a cough syrup container) in order to enable air to enter the container through the air hole at a sufficient rate to replace the discharged fluid. Moreover, the function of an air hole may be achieved in other ways, such as by air leaking into the container along a gap around attachment portion 20. For example, if the attachment portion 20 is loosely inserted into a groove in the neck of the container, air may enter in the gap between the groove and attachment portion 20. As another example of an effective air slit, if the attachment portion 20 comprises a corrugated or textured material, a plurality of air holes may be formed where attachment portion 20 meets neck 10. As still another example of an effective air slit, flexure of attachment portion 20 when flap 5 opens may uplift a portion of attachment portion 20 to form an air slit proximate to neck 10.

The design of the valve apparatus preferably also includes the selection of material types and layer thicknesses associated with a reasonable flap lifetime. The materials are preferably resistance to corrosion by the fluid to be poured. For example, a valve apparatus used to facilitate the smooth pouring of a liquid acid should be comprised of a plastic or polymer material resistant to attack by the acid to be poured. Another materials consideration is that the valve apparatus should be capable of a reasonable number of cycles. Some plastics, for example, have a fatigue lifetime. For example, a valve apparatus for a one gallon milk container should be capable of pouring at least eight glasses of milk (assuming eight ounce portions). In other applications, such as pouring small (e.g., one tablespoon) quantities of cooking oil from a large oil container (e.g., a one-quart container), it may be necessary that the valve apparatus be capable of dozens or even hundreds of cycles.

While the present invention has been discussed in detail with regard to pouring liquid from a container, many of the same principles apply to dispensing fine particles. As is well known, many types of fine particles have a low resistance to flow. Consequently, they act substantially like fluids in terms of their pouring behavior. For example many types of granular pool chemicals, dry detergent, and plant fertilizers are sold in containers that have a comparatively small orifice. In some cases, it is difficult to smoothly pour such granular chemicals directly from a container in a controllable manner. The granules tend to come out in spurts. This leads to waste and spillage analogous to liquid spillage. Moreover, chemical bums can result from the spurting of caustic chemicals, such as swimming pool chlorine particles. The inventive valve apparatus may thus be utilized to improve the pouring behavior of many types of chemicals sold as fine powders or particles. Consequently, as used within this application the term "fluid" also includes all fine powders or particles that act substantially like liquids in terms of their pouring behavior.

The neck region of a container is commonly defined as the part of the body joining a head to a trunk or as a relatively narrow portion of a structure. Although the present invention has been described with particularity for containers which have a neck region shown as a narrow portion of the container, it is commonly known that many products are sold in substantially cylindrically-shaped containers. Consequently, the term "neck" in the present invention may also refer to the cylindrical body disposed near the rim of a cylindrical container for those cases that the container has a substantially cylindrical shape. For example, tomato juice, paint, and a variety of other products are commonly sold in cylindrical cans. Many thermos bottles also have a substantially cylindrical shape. It is within the scope of the present invention that the inventive valve apparatus may also be coupled to a lip region of such substantially cylindrical containers.

In summary, the present invention generally comprises a flap dimensioned to obstruct a portion of the orifice of a container; an air hole or air slit to permit air to enter the container to replace the volume of the discharged fluid; means to bias the flap so that the flap is normally closed in the absence of fluid pressure acting on the flap and biased so that the flap progressively opens in response to increasing fluid pressure upon the flap; and means to couple the flap to the container. The inventive valve apparatus may be designed to either mate to the inside of the neck of a container or externally mate with the exterior surface of the neck of a container. The flap may either flex or tilt in response to increasing fluid pressure. In a preferred embodiment, the flap primarily tilts about a hinge comprised of a region of reduced materials thickness. The flap is preferably biased by the inherent resiliency of the hinge-region. However, the flap may also be biased using an additional leaf spring and/or by the resiliency of the attachment portion. The air hole preferably comprises an air slit dimensioned to function substantially as a one-way air valve that lets air in but that prevents liquid from exiting the air slit. An additional air tube may be used to communicate air into a container through the air slit a significant distance from the flap so that turbulence is reduced.

Although a preferred embodiment of the present invention and modifications thereof have been described in detail herein, it is to be understood that this invention is not limited to those precise embodiments and modifications, and that other modifications and variations may be affected by one of ordinary skill in the art without departing from the spirit and scope of the invention as defined in the appended claims.

What is claimed is:

1. A valve apparatus sized to fit in the lip region of a neck of a container to provide flow control for a fluid exiting from said container, comprising:

an attachment portion dimensioned to be coupled to the lip region of said container;

a flap portion coupled to said attachment portion, said flap portion sized and positioned to substantially obstruct the flow of fluid through the lip region of the container when said flap portion is in a closed position;

wherein said flap portion is resiliently biased with a bias selected so that said flap portion is in said closed position in the absence of fluid pressure acting on said flap portion and wherein said bias acts so that said flap portion opens a progressively greater amount in response to increasing fluid pressure against said flap portion, thereby decreasing the obstruction of said flap portion to the discharge of the fluid through said lip region as the fluid pressure against said flap portion increases;

whereby said valve apparatus moderates pressure surges of the discharged fluid.

2. The valve apparatus of claim 1, further comprising an air passage disposed in said attachment portion to communicate air into said container.

3. The valve apparatus of claim 2, wherein said air passage is dimensioned and positioned to have a resistance to the flow of the fluid selected so that said air passage substantially prevents the fluid from exiting the container from said air passage.

4. The valve apparatus of claim 3, wherein said air passage is an air slit with a maximum width less than about 0.060".

5. The valve apparatus of claim 4, further comprising an air tube coupled to said air slit and extending into the neck of said container past said lip region.

6. The valve apparatus of claim 5, wherein said air slit has a maximum width less than about 0.040" and said air tube has a maximum inner diameter less than about 0.060".

7. The valve apparatus of claim 6, wherein said air tube extends a sufficient length into said container to reduce turbulence of said fluid discharged from said container.

8. The valve apparatus of claim 1, further comprising an air passage disposed on the periphery of said flap portion.

9. The valve apparatus of claim 1, wherein said flap portion is coupled to said attachment portion by a hinge.

10. The valve apparatus of claim 9, further comprising a leaf spring arranged to regulate the bias on said flap portion.

11. The valve apparatus of claim 9, wherein said hinge comprises a resilient material.

12. The valve apparatus of claim 11, wherein said flap portion and said attachment portion comprise a resilient material and said hinge comprises a region of reduced material thickness.

13. The valve apparatus of claim 12, further comprising an air passage disposed in said attachment portion to communicate air into said container.

14. The valve apparatus of claim 13, wherein said air passage is dimensioned and positioned to have a resistance to the flow of fluid selected so that said air passage substantially prevents the fluid from exiting the container from said air passage.

15. The valve apparatus of claim 14, wherein said air passage is an air slit with a maximum width less than about 0.060".

16. The valve apparatus of claim 15, further comprising an air tube coupled to said air slit and extending into the neck of said container.

17. The valve apparatus of claim 16, wherein said air slit has a maximum inner diameter less than about 0.040" and said air tube has a maximum inner diameter less than about 0.060".

18. The valve apparatus of claim 17, wherein said air tube extends a sufficient length into said container to reduce turbulence of said fluid discharged from said container.

19. The valve apparatus of claim 1, wherein said attachment portion is coupled to a collar dimensioned to mate with the neck of said container.

20. A valve apparatus sized to fit in the lip region of a neck of a container to provide flow control for fluid exiting from said container, comprising:

an attachment portion dimensioned to be coupled to the lip region of said container, wherein said attachment portion is coupled to a collar dimensioned to mate with the neck of said container;

a flap portion coupled to said attachment portion, said flap portion sized and positioned to substantially obstruct the flow of fluid through the lip region of the container when said flap portion is in a closed position;

wherein said flap portion is resiliently biased so that said flap portion normally obstructs the flow of fluid through said lip region in the absence of fluid pressure acting on said valve apparatus but said flap portion opens a progressively greater amount in response to increasing fluid pressure against said flap portion and wherein said attachment portion includes a support frame, a plug disposed on said support frame, and a secondary air passage disposed in said support frame and said flap portion includes a primary air passage, said primary air passage dimensioned and positioned to mate with said plug when said flap portion is in a sealed flap position.

21. A valve apparatus sized to fit in the lip region of a neck of a container to provide flow control for a fluid exiting from said container, comprising:

an attachment portion dimensioned to couple with the lip region of the neck of said container, said attachment portion including an air passage to admit air into said container;

a flap portion connected to said attachment portion by a hinge, said flap portion sized and positioned to substantially obstruct the flow of fluid through said lip region when said flap portion is in a closed position;

wherein said flap portion is resiliently biased with a bias selected so that said flap portion is in said closed position in the absence of fluid pressure acting on said flap portion and wherein said bias acts so that said flap portion opens a progressively greater amount in response to increasing fluid pressure against said flap portion, thereby decreasing the obstruction of said flap portion to the discharge of the fluid through said lip region as the fluid pressure against said flap portion increases;

whereby said valve apparatus moderates pressure surges of the discharged fluid.

22. The valve apparatus of claim 21, wherein said air passage comprises a slit with a slit width less than 0.060".

23. The valve apparatus of claim 22, further comprising an air tube coupled to said air slit and communicating air to said container.

24. The valve apparatus of claim 22, wherein said hinge comprises a plastic material with a thickness less than 0.020" in thickness.

25. The valve apparatus of claim 24, further comprising a leaf spring arranged to regulate the bias on said flap portion.

26. A valve apparatus sized to provide flow control for a fluid discharged from a lip region of a neck of a container, comprising:

flap means for forming a movable obstruction to the flow of the fluid through the lip region of said container;

bias means for regulating the position of said movable obstruction;

coupling means for coupling said valve apparatus to the lip region of said container;

wherein said flap means is resiliently biased so that the flow of the fluid though the lip region is substantially obstructed in the absence of fluid pressure acting upon said valve apparatus but becomes progressively less obstructed with increasing fluid pressure acting upon said valve apparatus; whereby said valve apparatus moderates pressure surges of the discharged fluid.

27. The valve of claim 26, further comprising air passage means for admitting air into said container substantially continuously as fluid is poured from said container.

28. The valve of claim 27, wherein said air passage means comprises an air slit dimensioned to let air into said container while substantially preventing the flow of liquid from said air passage.

29. The valve of claim 26, wherein said resilient bias means comprises a resilient hinge.

30. The valve of claim 26, wherein said resilient bias means comprises the resilient flexure of said flap means.

* * * * *